US007077513B2

(12) United States Patent
Kimura et al.

(10) Patent No.: US 7,077,513 B2
(45) Date of Patent: Jul. 18, 2006

(54) INK JET RECORDING APPARATUS, CONTROL AND INK REPLENISHING METHOD EXECUTED IN THE SAME, INK SUPPLY SYSTEM INCORPORATED IN THE SAME, AND METHOD OF MANAGING INK AMOUNT SUPPLIED BY THE SYSTEM

(75) Inventors: Hitotoshi Kimura, Nagano (JP); Nobuhito Takahashi, Nagano (JP); Shuhei Harada, Nagano (JP); Atsushi Kobayashi, Nagano (JP); Hidekazu Mizuno, Nagano (JP); Taku Ishizawa, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 12 days.

(21) Appl. No.: 10/417,236

(22) Filed: Apr. 17, 2003

(65) Prior Publication Data

US 2003/0202059 A1 Oct. 30, 2003

Related U.S. Application Data

(62) Division of application No. 10/068,008, filed on Feb. 8, 2002, now Pat. No. 6,883,905.

(30) Foreign Application Priority Data

| | | |
|---|---|---|
| Feb. 9, 2001 | (JP) | P.2001-034187 |
| Feb. 9, 2001 | (JP) | P.2001-034188 |
| Apr. 27, 2001 | (JP) | P.2001-130997 |
| Apr. 27, 2001 | (JP) | P.2001-130998 |
| Aug. 17, 2001 | (JP) | P.2001-247677 |
| Aug. 17, 2001 | (JP) | P.2001-247678 |
| Sep. 3, 2001 | (JP) | P.2001-266043 |
| Sep. 3, 2001 | (JP) | P.2001-266044 |
| Nov. 29, 2001 | (JP) | P.2001-363784 |

(51) Int. Cl.
*B41J 2/175* (2006.01)
*B41J 2/195* (2006.01)

(52) U.S. Cl. ..... 347/85; 347/7

(58) Field of Classification Search ..... 347/5, 347/7, 19, 84, 85, 86, 87
See application file for complete search history.

(56) References Cited

U.S. PATENT DOCUMENTS

| | | | | |
|---|---|---|---|---|
| 4,067,020 A | | 1/1978 | Arway | |
| 4,677,448 A | | 6/1987 | Mizusawa et al. | |
| 4,694,307 A | * | 9/1987 | Toganoh et al. | 347/85 |
| 5,221,935 A | * | 6/1993 | Uzita | 347/36 |
| 6,151,039 A | * | 11/2000 | Hmelar et al. | 347/7 |

(Continued)

FOREIGN PATENT DOCUMENTS

EP 0 777 008 A1 6/1997

(Continued)

OTHER PUBLICATIONS

Japanese Abstract No. 05096741, dated Apr. 20, 1993.

(Continued)

*Primary Examiner*—Anh T. N. Vo
(74) *Attorney, Agent, or Firm*—Sughrue Mion, PLLC

(57) ABSTRACT

In an ink jet recording apparatus, at least one main tank stores ink therein. A plurality of subtanks are communicated with each main tank. Each subtank stores ink supplied from the main tank. Each subtank is communicated with at least one recording head.

37 Claims, 18 Drawing Sheets

U.S. PATENT DOCUMENTS

| | | | | |
|---|---|---|---|---|
| 6,168,268 | B1 * | 1/2001 | Sugiyama | 347/89 |
| 6,196,668 | B1 * | 3/2001 | Bode | 347/85 |
| 6,224,201 | B1 * | 5/2001 | Shigemura | 347/93 |
| 6,281,916 | B1 * | 8/2001 | VanSteenkiste | 347/85 |
| 6,883,905 | B1 * | 4/2005 | Kimura et al. | 347/85 |

FOREIGN PATENT DOCUMENTS

| | | | | |
|---|---|---|---|---|
| EP | 0 894 631 | A2 | 2/1999 | |
| EP | 0 916 502 | A2 | 5/1999 | |
| EP | 0 927 638 | A2 | 7/1999 | |
| EP | 0 965 451 | A2 | 12/1999 | |
| EP | 1 033 252 | A2 | 9/2000 | |
| EP | 1 050 412 | A2 | 11/2000 | |
| EP | 1 055 520 | A1 | 11/2000 | |
| EP | 1 057 644 | A2 | 12/2000 | |
| JP | 360228160 | A * | 11/1985 | 347/86 |
| JP | 410181043 | A * | 7/1998 | |
| JP | 11-20181 | * | 1/1999 | |
| JP | 11-157093 | A | 6/1999 | |
| JP | 2000-327964 | A | 11/2000 | |
| WO | WO 00/09339 | A | 2/2000 | |

OTHER PUBLICATIONS

Japanese Abstract No. 58194563, dated Nov. 12, 1983.

* cited by examiner

INK JET RECORDING APPARATUS, CONTROL AND INK REPLENISHING METHOD EXECUTED IN THE SAME, INK SUPPLY SYSTEM INCORPORATED IN THE SAME, AND METHOD OF MANAGING INK AMOUNT SUPPLIED BY THE SYSTEM

This is a divisional of application Ser. No. 10/068,008 filed Feb. 8, 2002 now U.S. Pat. No. 6,883,905; the disclosure of which is incorporated herein by reference.

BACKGROUND OF THE INVENTION

The present invention relates to an ink jet recording apparatus which records information on a recording medium with ink, a method of controlling the apparatus, and a method of replenishing ink stored in a main tank to a subtank for temporarily storing the replenished ink.

Further, the present invention relates to an ink supply system incorporated in the apparatus, and a method of managing the supplying ink amount executed by the ink supply system.

Recently, a digital camera provided with a CCD (charge coupled device) and a memory device has spread in place of a camera using a silver halide film. A picture taken by such a digital camera is recorded on a recording medium by a recording apparatus. As this recording apparatus, for example, an ink jet printer is used, and as a recording medium, for example, print paper is used. Under the circumstances, also in a laboratory where the silver halide film is developed and an image is printed on photographic paper thereby to make a photograph, an ink jet printer has been installed in order to print a digital image.

In this ink jet printer, a recording head, which pressurizes ink supplied from an ink tank and ejects an ink droplet, is reciprocated in the width direction of paper thereby to perform printing. The ink jet printer which can perform a large amount of printing by such the system includes a main ink tank having large volume (hereinafter referred to as a main tank) for each color, and a sub-ink tank (hereinafter referred to as a subtank) having small volume for each color, which is connected to each main tank by a tube. The subtank is airtightly formed of a flexible material having flexibility in the shape of a bag so as to be variable in volume.

As a method of increasing the number of prints per time in such a laboratory, it is considered that plural ink jet printers are operated. However, since many main tanks (multiplying the number of ink jet printers by the number of colors) are required, there is a problem on replacement of the main tanks.

In a case where ink is supplied from a single main tank for each color to print heads for each color of the plural ink jet printers, the number of the main tanks requires only the number of colors. However, in a case where the amount of ink ejection in the recording head is large, dynamic pressure in an ink supply passage becomes large, so that the ink supply runs short and printing quality lowers.

Further, since the dynamic pressure is produced due to the difference in length of the ink supply passage between the main tank and the print heads in the ink jet printer, the amount of the ink supply is different among the respective ink jet printers. For example, in a case where plural ink jet printers are laid horizontally, an ink jet printer located farthest from the main tank has the longest ink flowing passage. Therefore, in its ink jet printer, an ink supply time becomes longest. On the contrary, since an ink jet printer located nearest to the main tank has the shortest ink flowing passage, the ink supply time becomes shortest.

In a case where the main tank is arranged at the lowest position and plural ink jet printers are laid in the vertical direction, an ink jet printer located at the top has the longest ink flowing passage and also the largest pressure loss due to the head difference, so that the ink supply time becomes longest. On the contrary, an ink jet printer located at the lowest position has the shortest ink flowing passage and also the smallest pressure loss due to the head difference, so that the ink supply time becomes shortest.

Further, since the amount of ink consumption amount is large in the image printing by the plural ink jet printers, the amount management is important. Conventionally, such amount is managed every each ink jet printer.

SUMMARY OF THE INVENTION

It is therefore an object of the invention to provide an ink jet recording apparatus in which a main tank can be replaced readily, and ink can be efficiently supplied to plural recording units without causing deterioration of the printing quality.

It is therefore another object of the invention to provide an ink supply system for reliably managing ink amount to be supplied, and a method of managing ink supplying amount performed by the ink supply system.

In order to achieve the above objects, according to the present invention, there is provided an ink jet recording apparatus, comprising:

at least one main tank, which stores ink therein; and a plurality of subtanks, communicated with each main tank, each subtank storing ink supplied from the main tank, and being communicated with at least one recording head.

In this configuration, since ink is supplied from one main tank to the plural subtanks, even if the plural printers are used, the main tank is readily replaced. Further, the dynamic pressure in an ink supply passage between the main tank and each subtank does not affect to the recording of the recording head so that printing quality can be maintained.

Preferably, a plurality of main tanks are provided, so that the main tank can be quickly replaced for another main tank when the amount of the residual ink in a main tank is small without interrupting the recording operation. The empty main tank can be replaced with a new one thereafter.

Preferably, the subtanks are arranged in a vertical direction, so that the layout space of the plural recording apparatuses can be reduced, and the number of printers per a unit area can be increased.

Preferably, each subtank is airtightly formed by a material having flexibility so that a volume of the subtank is variable. Since it is not necessary to open an ink flowing passage to atmosphere, the recording can be performed while the deaeration state of ink is kept.

Here, it is preferable that each subtank contains a plate member which prevents inner surfaces of the subtank from being adhered with each other. Some troubles due to adhesion of the inner faces when the subtank is contracted.

Further, it is preferable that grooves are formed on surfaces of the plate member, so that ink supplied from the main tank can be smoothly introduced into the subtank by guiding the ink with the groove.

Preferably, the ink jet recording apparatus further comprises:

a first ink amount detector, which detects an ink amount stored in each subtank; and a first supply amount controller, which controls a supply amount of ink flowing into each subtank, based on the detection of the first ink amount detector.

In this configuration, even if there is the different in height between the main tank and the subtank, the reversal flow between two tanks can be prevented.

Here, it is preferable that the first supply amount controller is provided as a first valve member. The first valve member is opened when the first ink amount detector detects an ink low state in which the ink amount stored in the subtank is a first predetermined level or less. The first valve member is closed when the first ink amount detector detects an ink full state in which the ink amount stored in the subtank is a second predetermined level or more. Since it is possible to prevent the ink in the subtank from running short, the ink can be sufficiently supplied to the plural recording apparatuses which consume a large amount of the ink.

Further, it is preferable that the apparatus further comprises a second supply amount controller, which controls a supply amount of ink flowing out of the main tank. Since the ink supplying passage from the main tank to the subtank can be closed on the main tank side, the main tank can be replaced without causing mixing of air in the ink supplying passage and ink leakage during the printing operation.

Here, it is preferable that the second supply amount controller is provided as a second valve member. The second valve member is first opened while the main tank is compressed, and then the first valve member is opened to supply ink to the subtank. When the pressurization control error or the control error of the first valve is occurred, the ink flow system can be arranged on the safety side by closing the second valve. Therefore, reliability of the ink supply control can be improved.

Further, it is preferable that the first valve member is first closed and the compressing of the main tank is canceled when the subtank is replenished, and the second valve member is then closed so that it is avoided a situation that the apparatus is deactivated while the ink supplying passage between the first valve member and the second valve member is kept in the pressurized state and the ink supplying passage is left as it is for a long time. Therefore, the ink leakage from the ink supplying passage can be prevented and safety can be improved.

Preferably, the subtank is communicated with a plurality of recording heads, so that the freedom of the design can be enhanced by the layout of the plural heads.

Preferably, the main tank and the subtanks are arranged so as to provide a head difference therebetween, to supply ink from the main tank to the subtanks. Since the main tank is always in a pressurized state due to the head difference, the ink can be supplied surely by the simple structure.

Preferably, the main tank is compressed to supply ink to the subtanks, so that the main tank can surely supply the ink even if it is arranged below the subtanks. Here, it is preferable that the main tank is compressed by a pump member.

Further, it is preferable that the pump member is connected to the main tank via an air releaser which opens the main tank to atmosphere. When the ink supply is not required, the pressurized state can be released so that breakdown of the apparatus due to keeping of the pressurized state can be eliminated. Accordingly, reliability can be improved, and safety in times of a pressurization control error and an ink supply error can be improved.

According to the present invention, there is also provided an ink jet recording apparatus, comprising:

at least one main tank, which stores in therein;

a plurality of recording sections, communicated with each main tank, each recording section including a subtank which stores ink supplied from the main tank, and at least one recording head communicated with the subtank; and a system controller, which controls the main tank and the recording sections such that a recording section in which a time period required for supplying ink from the main tank to the subtank is shorter is controlled with a higher priority.

Preferably, a recording section in which a path length connecting the main tank and the subtank is shorter is controlled with a higher priority.

In a case where the amount of recording increases, since much ink can be distributed to the recording unit in which the ink supply finishes quickly the ink supply time can be reduced.

Preferably, each subtank is airtightly formed by a material having flexibility so that a volume of the subtank is variable. Since it is not necessary to open an ink flowing passage to atmosphere, the recording can be performed while the deaeration state of ink is kept.

Here, it is preferable that each subtank contains a plate member which prevents inner surfaces of the subtank from being adhered with each other. Some troubles due to adhesion of the inner faces when the subtank is contracted.

Further, it is preferable that grooves are formed on surfaces of the plate member, so that ink supplied from the main tank can be smoothly introduced into the subtank by guiding the ink with the groove.

Preferably, the ink jet recording apparatus further comprises:

a first ink amount detector, which detects an ink amount stored in each subtank; and a first supply amount controller, which controls a supply amount of ink flowing into each subtank, based on the detection of the first ink amount detector.

In this configuration, even if there is the different in height between the main tank and the subtank, the reversal flow between two tanks can be prevented.

Here, it is preferable that the first supply amount controller is provided as a first valve member. The first valve member is opened when the first ink amount detector detects an ink low state in which the ink amount stored in the subtank is a first predetermined level or less. The first valve member is closed when the first ink amount detector detects an ink full state in which the ink amount stored in the subtank is a second predetermined level or more. Since it is possible to prevent the ink in the subtank from running short, the ink can be sufficiently supplied to the plural recording apparatuses which consume a large amount of the ink.

Further, it is preferable that the apparatus further comprises a second supply amount controller, which controls a supply amount of ink flowing out of the main tank. Since the ink supplying passage from the main tank to the subtank can be closed on the main tank side, the main tank can be replaced without causing mixing of air in the ink supplying passage and ink leakage during the printing operation.

Here, it is preferable that the second supply amount controller is provided as a second valve member. The second valve member is first opened while the main tank is compressed, and the first valve member is then opened to supply ink to the subtank. When the pressurization control error or the control error of the first valve is occurred, the ink flow system can be arranged on the safety side by closing the second valve. Therefore, reliability of the ink supply control can be improved.

Further, it is preferable that the first valve member is first closed and the compressing of the main tank is canceled when the subtank is replenished, and the second valve is then closed so that it is avoided a situation that the apparatus is deactivated while the ink supplying passage between the first valve member and the second valve member is kept in the pressurized state and the ink supplying passage is left as it is for a long time. Therefore, the ink leakage from the ink supplying passage can be prevented and safety can be improved.

Preferably, the subtank is communicated with a plurality of recording heads, so that the freedom of the design can be enhanced by the layout of the plural heads.

Preferably, the main tank and the subtanks are arranged so as to provide a head difference therebetween, to supply ink from the main tank to the subtanks. Since the main tank is always in a pressurized state due to the head difference, the ink can be supplied surely by the simple structure.

Preferably, the main tank is compressed to supply ink to the subtanks, so that the main tank can surely supply the ink even if it is arranged below the subtanks. Here, it is preferable that the main tank is compressed by a pump member.

Further, it is preferable that the pump member is connected to the main tank via an air releaser which opens the main tank to atmosphere. When the ink supply is not required, the pressurized state can be released so that breakdown of the apparatus due to keeping of the pressurized state can be eliminated. Accordingly, reliability can be improved, and safety in times of a pressurization control error and an ink supply error can be improved.

According to the present invention, there is also provided a method of controlling the above ink jet recording apparatus to record information on a recording medium with ink.

According to the present invention, there is also provided a method of initially filling a subtank with ink stored in a main tank which is communicated with the subtank, comprising the steps of:

a) applying negative pressure to a recording head communicated with the subtank, to discharge air in the subtank while compressing the subtank, b) opening a valve member provided between the main tank and the subtank, after the step a), to supply ink from the main tank to the subtank;

c) closing the valve member after the step b);

d) applying negative pressure to the recording head, after the step c), to discharge air and ink in the subtank while compressing the subtank; and e) opening the valve member, after the step d), to supply ink from the main tank to the subtank.

Air in the flowing passage from the recording head through the subtank to the valve member can be exhausted by the first negative pressure application, and air in the flowing passage from the valve member to the main tank can be exhausted by the second negative pressure application. Therefore, air in the flowing passage from the recording head to the main tank can be eliminated, and deaeration of the ink filling the subtank can be improved.

Preferably, the initial filling method further comprises:

f) closing the valve member, after the step e);

g) applying negative pressure to the recording head, after the step f), to partly discharge ink in the subtank; and h) opening the valve member, after the step g), to supply ink from the main tank to the subtank.

The ink flowing in the depressed subtank flows at a high speed bubbles and its deaeration is lost. However, by exhausting the predetermined amount of ink in the ink under this state and allowing new ink to flow in the subtank, the deaeration of the ink filling the subtank can be further improved.

Alternatively, the initial filling method further comprises:

f) closing the valve member, after the step e); and g) applying negative pressure to the recording head, after the step f), to supply ink from the subtank to the recording head.

Since particularly the air in the recording head can be completely exhausted, the ejection performance of the ink droplet can be maintained.

Preferably, the steps c) to e) are repeated so air in the flowing passage from the recording head to the main tank can be completely eliminated, so that the deaeration of the ink filling the subtank can be improved more.

According to the present invention, there is also provided a method of initially filling a subtank with ink stored in a main tank which is communicated with the subtank, comprising the steps of:

a) applying negative pressure to a recording head communicated with the subtank, to discharge air in the subtank while compressing the subtank;

b) opening a valve member provided between the main tank and the subtank, after the step a), to supply ink from the main tank to the subtank;

c) closing the valve member after the step b); and d) applying negative pressure to the recording head, after the step c), to supply ink from the subtank to the recording head.

According to the present invention, there is also provided an ink jet recording apparatus in which the initial filling methods are performed.

Preferably, the main tank is located above the subtank or is located below while being compressed, so that not only in a type in which the main tank is pressurized to supply the ink to the subtank but also in a type in which head difference is given between the main tank and the subtank to supply the ink, the air in the flowing passage from the recording head to the main tank can be eliminated. Accordingly, the deaeration of the ink filling the subtank can be improved.

Here, it is preferable that the subtank is airtightly formed by a material having flexibility so that a volume of the subtank is variable. The subtank contains a plate member which prevents inner surfaces of the subtank from being adhered with each other. In this configuration, uniformly pressurized state can be provided anywhere inside of the subtank so that remaining air therein can be eliminated.

According to the present invention, there is also provided an ink supply system, comprising:

at least one main tank, which stores ink therein;

a plurality of subtanks, communicated with each main tank, each subtank communicated with at least one recording section; and a system controller, which monitors an ink amount consumed in each subtank to manage a residual ink amount in the main tank.

By only managing the ink in one main tank, ink supply to the plural recording units is stabilized.

Preferably, each subtank is airtightly formed by a material having flexibility so that a volume of the subtank is variable. Since it is not necessary to open an ink flowing passage to atmosphere, the recording can be performed while the deaeration state of ink is kept.

Here, it is preferable that each subtank contains a plate member which prevents inner surfaces of the subtank from being adhered with each other. Some troubles due to adhesion of the inner faces when the subtank is contracted.

Further, it is preferable that grooves are formed on surfaces of the plate member, so that ink supplied from the main tank can be smoothly introduced into the subtank by guiding the ink with the groove.

Preferably, the system controller starts to count the consumed ink amount of the subtank when an ink amount stored in the subtank becomes a predetermined level. Since the state of the ink consumption in the subtank is known during the recording operation by the recording unit, the ink management for each recording unit is facilitated.

Here, it is preferable that the system controller regards a total ink amount consumed in all the subtanks as an ink amount consumed in the main tank, so that the consumed ink amount in the main tank can be recognized exactly.

Preferably, the system controller obtains the consumed ink amount of each subtank every time when the subtank is replenished with ink supplied from the main tank. Accuracy between the total of the counted ink consumption amount in the subtank and the consumed ink amount in the main tank can be improved. Further, since the ink is supplied every each subtank, the subtanks other than the subtank to which the ink is supplied are used for recording, so that interruption during the recording operation by the recording unit can be reduced.

Preferably, the system controller selectively supplies ink to at least one subtank which requires an ink replenishment, and obtains the consumed ink amount of the at least one subtank. Loss in supply time of ink from the main tank to the subtank can be reduced.

Preferably, the system controller obtains the consumed ink amount of each subtank, and supplies ink to all the subtanks simultaneously. The loss of the ink supplying time from the main tank to the subtanks can be reduced.

Preferably, a flow rate of ink flowing into the subtank is greater than a flow rate of ink flowing out from the recording section associated with the subtank. The ink supply from the main tank to the subtank is surely performed, and it is possible to prevent the situation in which the recording unit cannot perform the recording operation.

Preferably, the system controller starts to supply ink to the subtank when the ink amount consumed in the subtank exceeds a threshold level. When the consumed ink amount in the subtank is small, since the system controller can operate so as not to supply the ink from the main tank, loss due to interruption of the recording operation by the recording unit, which is caused by the ink supply, can be reduced.

Here, it is preferable that the threshold level includes a first threshold level selected while the recording section performs recording, and a second threshold level which is smaller than the first threshold level selected while the recording is not performed. The loss reduction can be effectively attained.

Further, it is preferable that each subtank is provided with at least one detector which detects a residual ink amount therein. The system controller stops the ink supply when the detection of the detector is effected. The ink supply amount can be exactly recognized, and the ink cost can be reduced.

Preferably, each subtank is provided with at least one detector which detects a residual ink amount therein. The system controller starts to supply ink to the subtank when the detector detects that the residual ink amount is a predetermined level or less. Since the detection accuracy of the amount of the residual ink in the subtank can be improved, the ink supply from the main tank to the subtank can be efficiently performed.

Here, it is preferable that a plurality of detectors are provided with each subtank. The system controller starts to supply ink to the subtank when the detection of one detector is effected, and stops the ink supply when the detection of another detector is effected. The exact amount of the residual ink can be recognized.

Further, it is preferable that the detector is solely provided, so that a cost of the residual ink amount detector can be reduced.

Here, it is preferable that the system controller supplies ink to the subtank during the detection of the detector is effected, so that the supply time can be reduced.

Alternatively, it is preferable that the system controller supplies ink to the subtank for a predetermined time period when the detection of the detector is effected, so that the ink supply amount can be increased.

Preferably, a valve member is provided between the main tank and each subtank. The valve member is closed when the detector detects that the residual ink amount is a predetermined level or more. Since the amount of the residual ink in the subtank can be surely detected, troubles not occurred in the ink supply from the main tank to the subtank.

Here, it is preferable that each valve member is closed independently from another valve members. Alternatively, it is preferable that each valve member is closed selectively. Alternatively, all the valve members are closed simultaneously. Hereby, the ink supply from the main tank to the subtank can be readily performed.

Here, it is preferable that all the valve members are closed when at least one detector among the detectors of the subtanks detects that one subtank is almost empty. It is possible prevent, for example, the situation in which the ink moves from the upper recording unit to the lower recording unit due to the head difference when the valves of all the subtanks are open.

Preferably, the system controller supplies ink from the main tank to each subtank every time when the system is activated. The loss due to the interruption of the recording operation by the recording unit, which is caused by the ink supply from the main tank to the subtank, can be reduced.

Preferably, the system controller supplies ink from the main tank to each subtank every time when a predetermined time period elapses. Even if the apparatus is regularly activated, the ink supply from the main tank to the subtank can be surely performed.

Preferably, the system controller supplies ink from the main tank to the subtank after obtaining the consumed ink amount of each subtank to calculate a residual ink amount in the main tank, every time when the recording section performs recording. The total of the consumed ink amount in the subtanks becomes equal to the consumed ink amount of the main tank, and the ink supply from the main tank to the subtank can be surely performed.

Preferably, the system controller obtains the consumed ink amount of each subtank every time when the recording section performs recording to calculate a residual ink amount in the main tank. An ink end state is effected in all the recording section when the residual ink amount in the main tank is a predetermined level or less. The total of the consumed ink amount in the subtanks becomes equal to the consumed ink amount of the main tank, and the ink supply from the main tank to the subtank can be surely performed.

Here, it is preferable that the recording section continues the recording until a predetermined amount of ink in the subtank is consumed after the ink end state is effected. The amount of the residual ink in the main tank is exactly counted, and the ink in the subtank is not used uselessly.

Preferably, the system controller sequentially compares the ink amount consumed in each subtank and a residual ink amount in the main tank. The system controller supplies ink to the compared subtank when the consumed ink amount in the compared subtank is less than the residual ink amount. An ink end state is effected when the consumed ink amount is greater than the residual ink amount. The ink supply from the main tank to the subtank can be surely performed.

Here, it is preferable that the ink supply is once performed even when the ink end state is effected, so that the ink in the main tank can be consumed as much as possible even if there is the unevenness in the amount of the residual ink in the main tank.

Further, it is preferable that the ink supply is performed until any change is not occurred in the detector, even when the ink end state is effected. The influence of the unevenness in the consumed ink amount can be eliminated.

Preferably, the system controller sequentially compares the ink amount consumed in each subtank and a residual ink amount in the main tank. The system controller supplies ink to the compared subtank when the consumed ink amount of the compared subtank is less than the residual ink amount. The system controller does not supply ink to the compared subtank when the consumed ink amount of the compared subtank is greater than the residual ink amount. An ink end state is effected when there is at least one subtank to which ink is not supplied, so that the useless ink amount can be reduced.

Preferably, the main tank is provided with a first detector which detects a residual ink amount in the main tank. An ink end state is effected when the first detector detects that the residual ink amount is a predetermined amount or less.

Here, it is preferable that each subtank is provided with a second detector which detects a residual ink amount therein. The system controller stops the ink supply when the second detector detects that the subtank is almost full when the ink end state is effected. The system constitution can be simplified.

Preferably, the ink supply system further comprises a memory for storing a residual ink amount in the main tank, so that the ink amount in the main tank can be managed with higher accuracy even if the main tank is replaced.

According to the present invention, there is also provided a method of managing an ink amount supplied from main tank to the subtanks which are provided in the above ink systems.

According to the present invention, there is also provided an ink supply system, comprising:

at least one main tank, which stores ink therein, a plurality of recording heads, communicated with each main tank while providing a head difference therebetween; and a system controller, which monitors an ink amount consumed in each recording head to manage a residual ink amount in the main tank.

By only monitoring the amount of ink consumption of each recording head, it is possible to prevent the ink in the main tank from running short. Further, as long as the ink remains in the main tank, ink supply to each recording head is always performed. Therefore, by the simple control system, high quality recording can be performed.

Preferably, the ink supply system further comprises a memory for storing a residual ink amount in the main tank, so that the ink amount in the main tank can be managed with higher accuracy even if the main tank is replaced.

According to the present invention, there is also provided a method of managing an ink amount supplied from main tank to the subtanks which are provided in the above ink systems.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Preferred embodiments of the present invention will be described below in detail with reference to the accompanying drawings.

Figure 1:
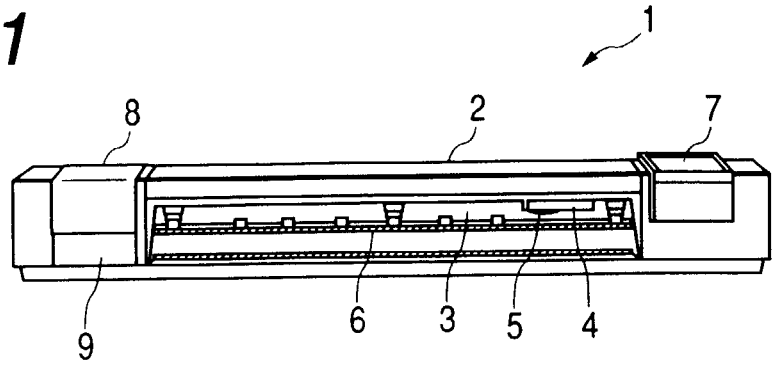
FIG. 1 is a front view showing an exterior constitution of an ink jet recording apparatus according to a first embodiment of the invention.

In a printer 1 shown in FIG. 1 that is one of the ink jet recording apparatus according to a first embodiment, a frame 2 is so formed as to define a window 3 having a width in which print paper can pass through. A recording head 5 mounted on a carriage 4 that reciprocates in the main scanning direction is arranged at the upper portion of the window 3, and a paper guide 6 for supporting the print paper is arranged at the lower portion of the window 3. On the right side of the frame 2, an operation panel 7 for operating a control unit included in the printer is arranged, and on the left side of the frame 2, an ink tank container 9 is arranged, which is covered with a cover 8 that can be opened and closed. An ink tank is detachably accommodated therein.

Usually, the recording head 5 in the printer 1 is composed of a black ink recording head that ejects black ink and a color ink recording head that ejects ink of each of plural colors such as yellow, cyan, and magenta, so that a full color image can be printed. The recording head for each color is connected to a subtank of the corresponding color with a pipe line. Under this constitution, while the print paper is intermittently fed in the sub-scanning direction by the predetermined amounts, the carriage 4 is moved in the main scanning direction, and ink supplied from the subtank to the recording head 5 is ejected on the print paper as ink droplets thereby to perform printing.

Figure 2:
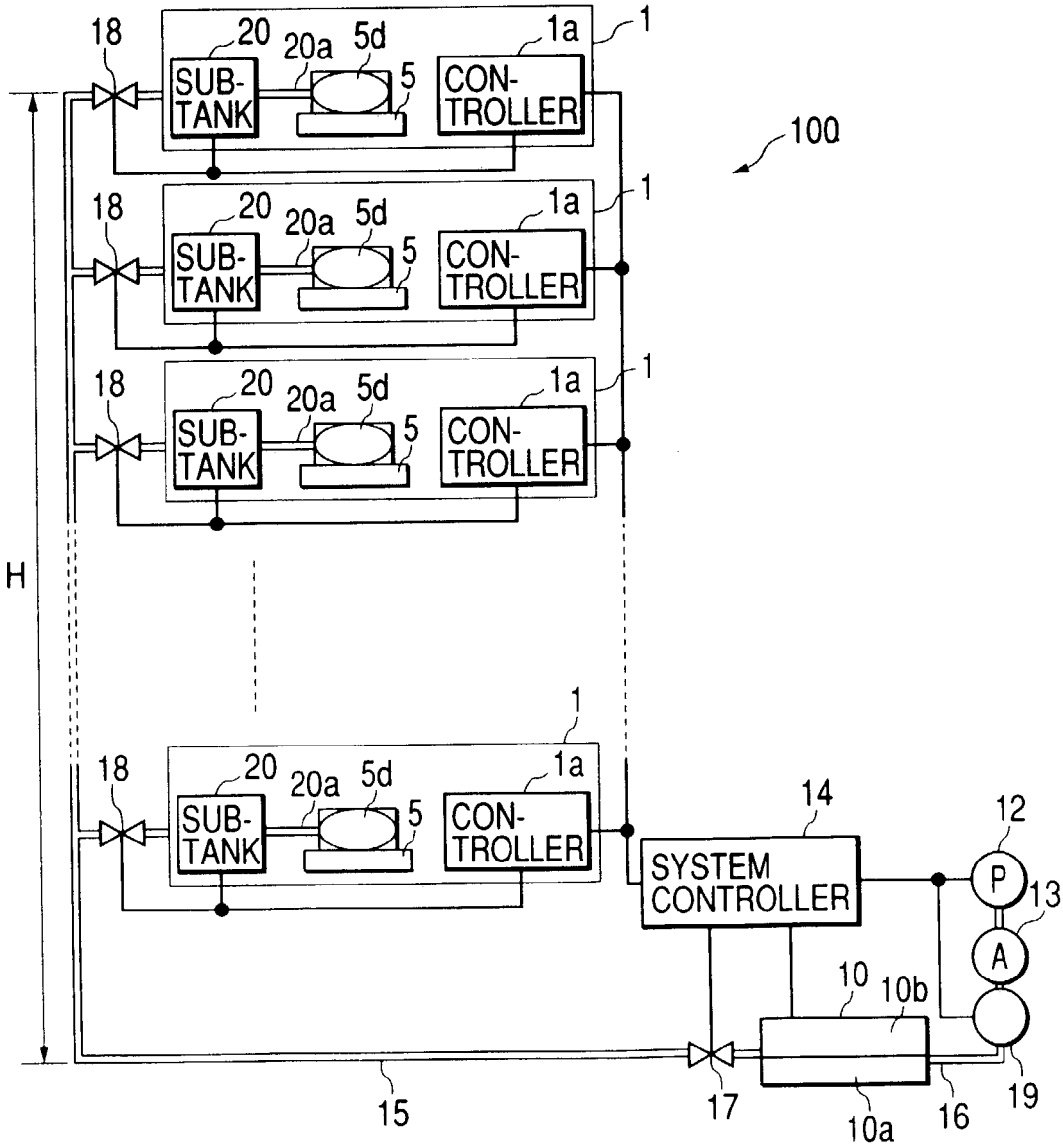
FIG. 2 is a diagram showing the schematic constitution of the ink jet recording apparatus according to the first embodiment.

As shown in FIG. 2, an ink jet recording system 100 according to this embodiment includes a plurality of the printers 1, a single main tank 10, an air pump 12, an accumulator 13, an air releaser 19, and a system controller 14. The plural printers 1 are vertically arranged with the difference in height H.

The main tank 10 is divided into an air chamber 10*a* and an ink pack 10*b*. The ink pack 10*b* is connected to a subtank 20 provided for each printer 1 by a pipe line 15, and ink stored therein is supplied to the subtank 20 of each printer 1. The subtank 20 is connected through a damper 5*d* to the recording head 5 by a pipe line 20*a*, so that ink stored therein is supplied to the recording head 5.

The air pump 12 is connected to the air chamber 10*a* of the main tank 10 by a pipe line 16, through the accumulator 13 and the air releaser 19, so that intake air is supplied to the air chamber 10*a* of the main tank 10. The accumulator 13 stabilizes pressure fluctuation in the air pump 12. To operate the ink jet recording system 100, however, the accumulator 13 is not essential. The air releaser 19 release air within the pipe line 16 and the air chamber 10*a* to atmosphere to thereby cancel the pressurized state produced by the air pump 12.

An electromagnetic valve 17 (hereinafter, main valve) is provided for the pipe line 15 in the vicinity of the main tank 10, and an electromagnetic valve 18 (hereinafter, subvalve) is provided for the pipe line 15 in the vicinity of each subtank 20. The system controller 14 is electrically connected to a controller 1*a* of each printer 1, the main tank 10, the air pump 12, the main valve 17, and the air releaser 19, to perform driving each printer 1, the air pump 12 and the air releaser 19, to check the residual amount of ink in the main tank 10, and to open/close the main valve 17. Further, the controller 1*a* of each printer 1 is electrically connected to the subvalve 18 and the subtank 20, to open/close the subvalve 18 and to check the residual amount of ink in the sub-main tank 20.

In FIG. 2, for convenience, the main tank 10, the pipe lines 15, 16, and the subtanks 20 are not shown every each color ink. As a matter of fact, the main tank 10 and the subtanks 20 are provided every each color and connected to each other by the pipe lines 15, 16 for each color.

As described above, since ink is supplied from one main tank 10 to the plural subtanks 20, even if the plural printers 1 are provided, the maintenance work is completed by only exchanging the one main tank, so that the work performance can be improved. The dynamic pressure in the pipe line 15 between the main tank 10 and the subtank 20 does not give the influence to the operation of the recording head 5, so that the print quality can be maintained. Although the plural printers 1 are arranged with the difference in height H, the subtank 20 in each printer 1 is arranged such that head difference between the subtank 20 and the recording head 5 is made constant.

Further, a plurality of main tanks may be provided in the recording system 100. In this case, when the amount of the residual ink therein becomes low, an operating tank can be quickly switched for another main tank. Therefore, while the switched main tank is used, the original main tank 10 can be replaced with a new main tank filled with ink.

Further, a plurality of recording heads may be provided with respect to the subtank 20. However, in this case, the number of nozzles per a recording head and the ink amount ejected in a unit time period should be considered such that a dynamic pressure generated in the pipe line 20*a* when the plural recording heads are operated is below a problematic level, while considering also a static pressure defined by the layout of the recording heads an the subtank 20 in the vertical direction. The design freedom is enhanced with the plural recording heads if the above condition is satisfied.

Figure 3:
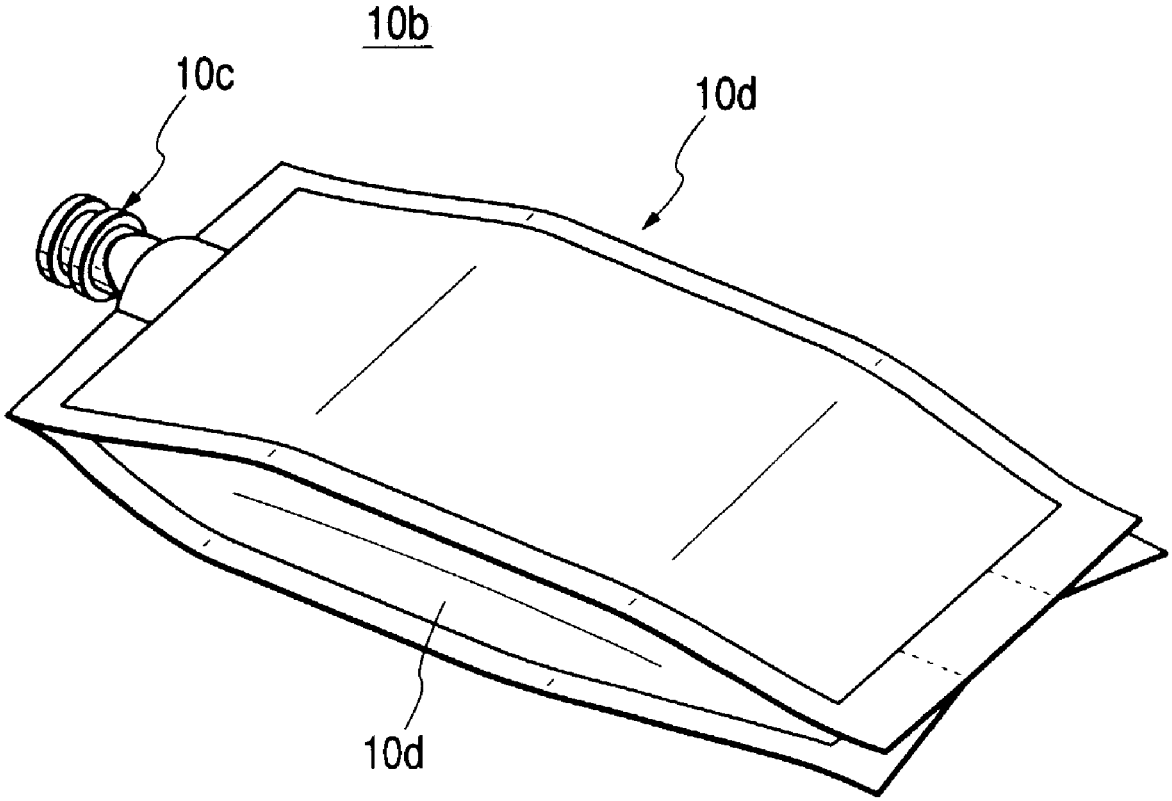
FIG. 3 is a perspective view showing the detailed structure of an ink pack of a main tank in the ink jet recording apparatus in FIG. 2.

As shown in FIG. 3, the ink pack 10*b* is an airtight pack made of a flexible material and having a size so as to be variable in volume in accordance with the ink amount stored therein, for example, about 1000 cc. On one short side thereof, a connection port 10*c* connected to the pipe line 15 is provided. A center portion on the other short side is deposited in order to prevent excess expansion. On long sides, gores 10*d* are provided to positively gain an expandable capacity.

As a material of the ink pack 10*b* of the main tank 10, for example, an aluminum laminating film can be used in order to secure gas barrier property, in which an aluminum foil is interposed as a middle layer between two films, for example, a nylon film on the outer side and a polyethylene film on the inner side. Further, a translucent film can be also used, in which silicon oxide is evaporated on a surface of a polymer film such as polyester or nylon thereby to form a silicon oxide layer is formed, and a polymer film such as polyethylene having good heat-welding property is laminated on these surfaces.

Figure 4A:
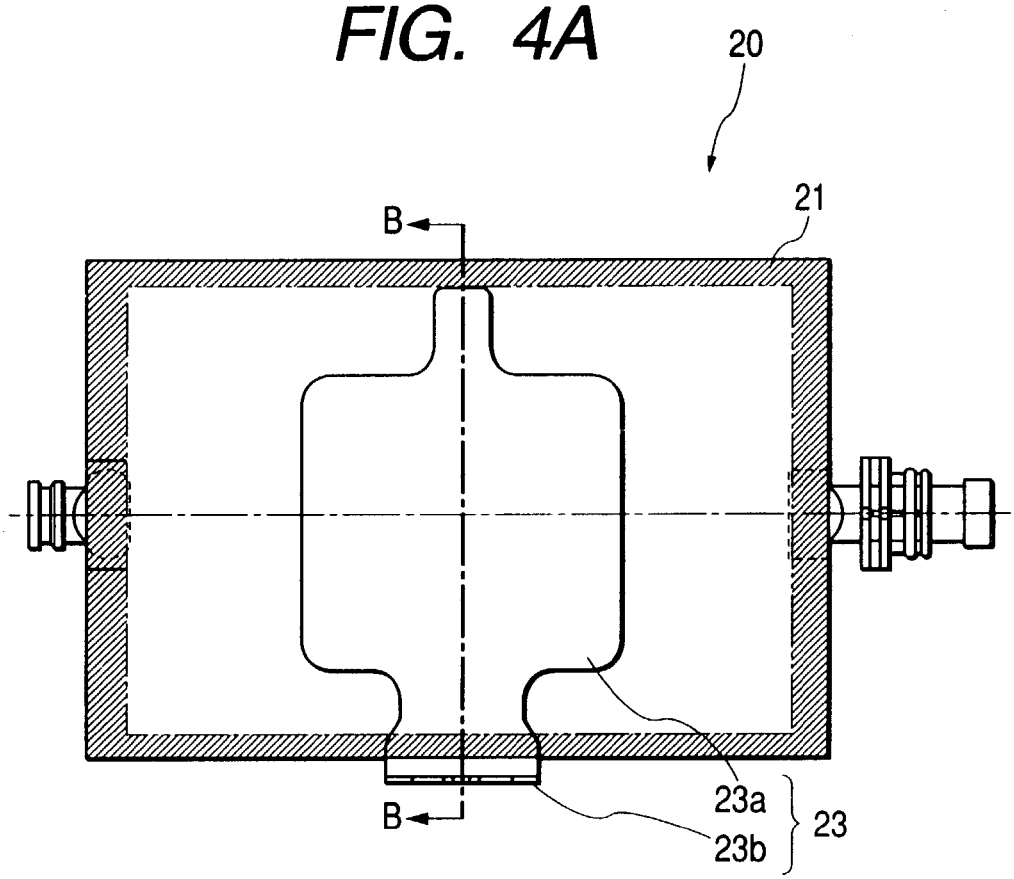
FIG. 4A is a plan view showing the detailed structure of a subtank in the ink jet recording apparatus in FIG. 2.
Figure 4B:
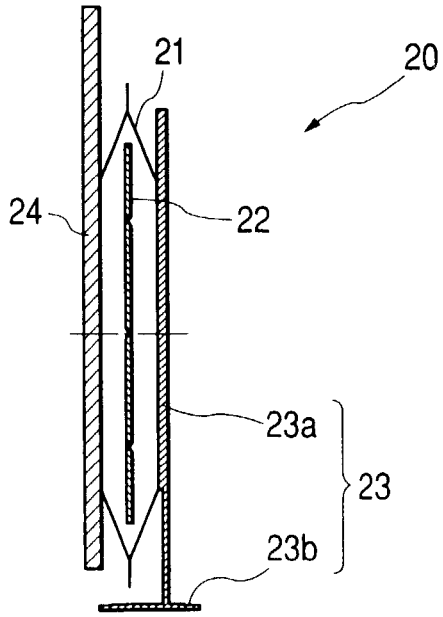
FIG. 4B is a section view taken along a line B—B in FIG. 4A.

As shown in FIGS. 4A and 4B, the subtank 20 includes an ink pack 21 in which ink is stored, an adhesion guard 22 for preventing mutual adhesion of the inner surfaces of the ink pack 21, an ink amount detector 23 for detecting the amount of ink in the ink pack 21, and a fixing plate 24 on which the ink pack 21 is fixed.

On one surface of the ink pack 21, the ink amount detector 23 is bonded; and on the other surface of the ink pack 21, the fixing plate 24 is bonded. The ink amount detector 23 includes a plate-shaped bonded part 23*a* that is bonded on one surface of the ink pack 21, and a plate-shaped detector part 23*b* that is integrally formed at the lower portion of this bonded part 23*a* so as to perpendicularly extend from the surface of the bonded part 23*a*.

Figure 5:
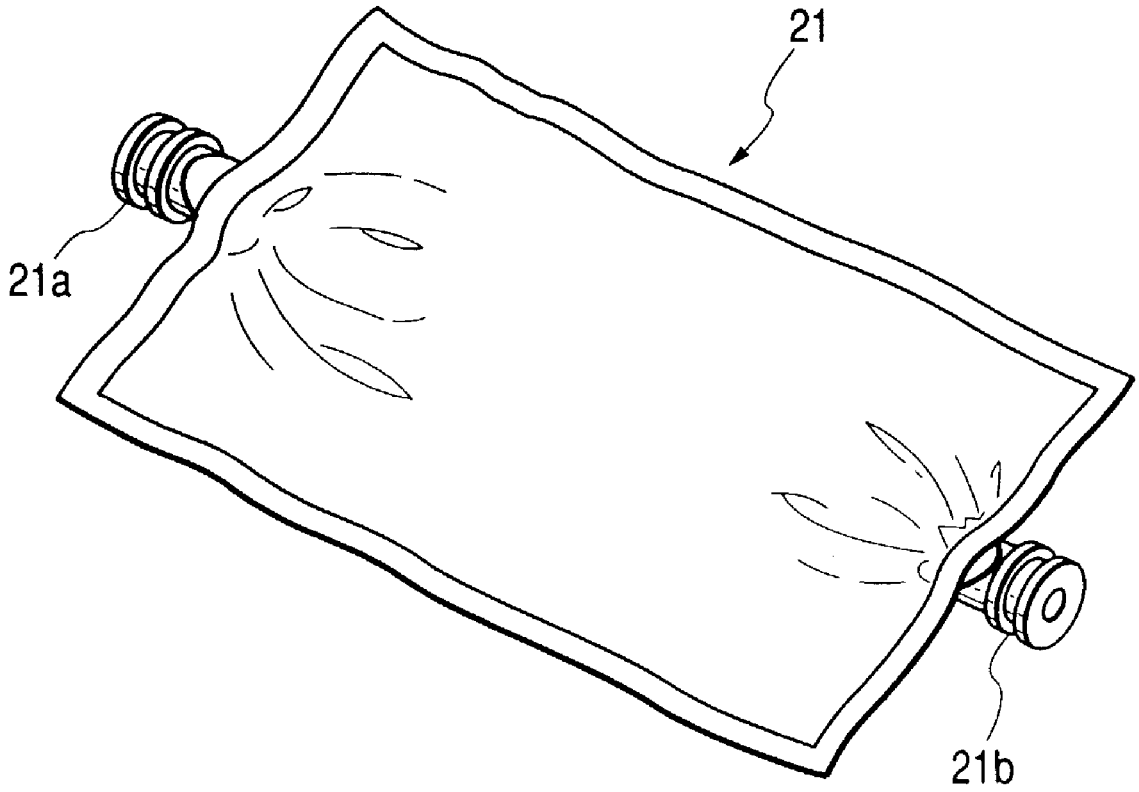
FIG. 5 is a perspective view showing the detailed structure of an ink pack of the subtank.

As shown in FIG. 5, the ink pack 21 is an airtight pack made of a flexible material and having a size so as to be variable in volume in accordance with the ink amount stored therein, for example, about 5 to 300 cc. On the opposed sides thereof, an inlet 21*a* connected to the pipe line 15 and an outlet 21*b* connected to the pipe line 20*a* are provided.

As a composing material of the ink pack 21 of the subtank 20, for example, an aluminum laminating film can be used in order to secure gas barrier property, in which an aluminum foil is interposed as a middle layer between two films, for example, a nylon film on the outer side and a polyethylene film on the inner side. Further, a translucent film can be also used, in which silicon oxide is evaporated on a surface of a polymer film such as polyester or nylon thereby to form a silicon oxide layer is formed, and a polymer film such as polyethylene having good heat-welding property is laminated on these surfaces.

Since the ink pack 21 of the subtank 20 has flexibility, even if the ink supply from the main tank 10 to the subtank 20 is forcedly performed, the ink does not leak from the recording head 5 and meniscus of a nozzle of the recording head 5 is not damaged. Further, since the ink is not exposed to atmosphere, it is not oxidized, so that restriction in an inner diameter and a length of an ink flowing passage from the main tank 10 to the subtank 20 are eliminated. Therefore, printing can be performed while the deaeration state of the ink is maintained. Moreover, the amount of the residual ink can be detected by the change in thickness of the ink pack.

Here, the ink pack 21 of the subtank 20 may be formed of a hard material. In this case, a member such as a detector that can detect the liquid surface in the ink pack 21 of the subtank 20 is used for detection of the residual ink amount.

Besides, when initial ink filling from the main tank 10 to the subtank 20 is performed, even if the ink pack 21 is evacuated once, it is possible to prevent the mutual adhesion of the inner surfaces of the ink pack 21 by the adhesion guard 22. Therefore, the initial ink filling can be smoothly performed. Further, even if the subtanks 20 of the plural colors are provided, reversal flow of the ink of the different color from the recording head 5, which is produced when one of their ink packs 21 is closed, can be prevented.

Figure 6A:
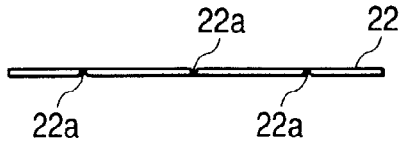
FIG. 6A is a short side view of an adhesion guard.
Figures 6B, 6C, 6D:
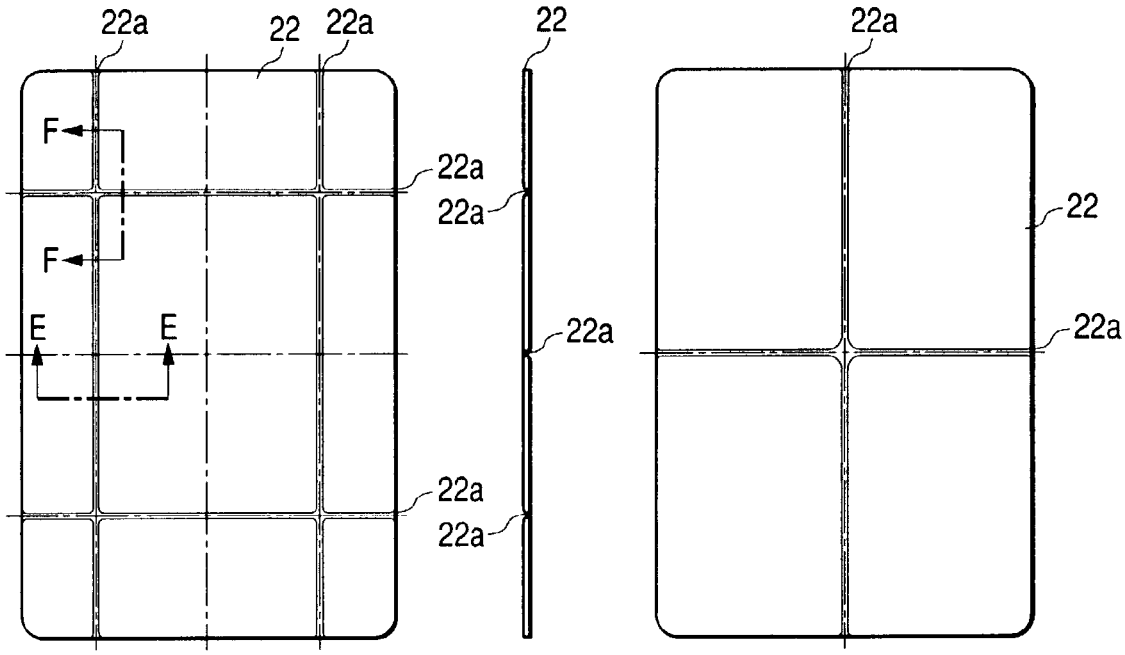
FIG. 6B is a top plan view of the adhesion guard.
FIG. 6C is a long side view of an adhesion guard.
FIG. 6D is a bottom plan view of the adhesion guard.
Figure 6E:
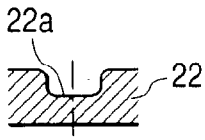
FIG. 6E is a section view taken along a line E—E in FIG. 6B.
Figure 6F:
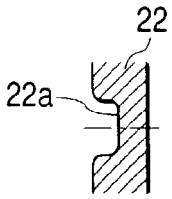
FIG. 6F is a section view taken along a line F—F in FIG. 6B.
Figure 7A:
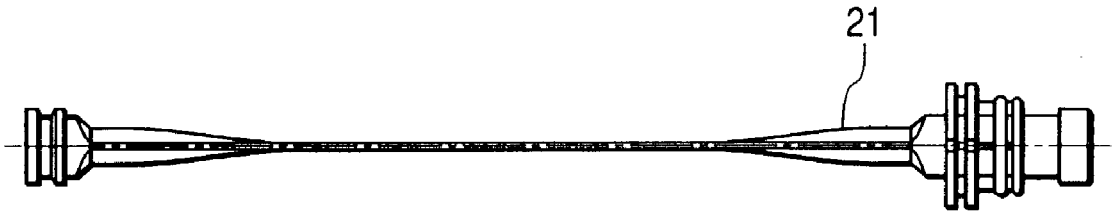
FIG. 7A is a side view showing the layout state of the adhesion guard in the subtank.
Figure 7B:
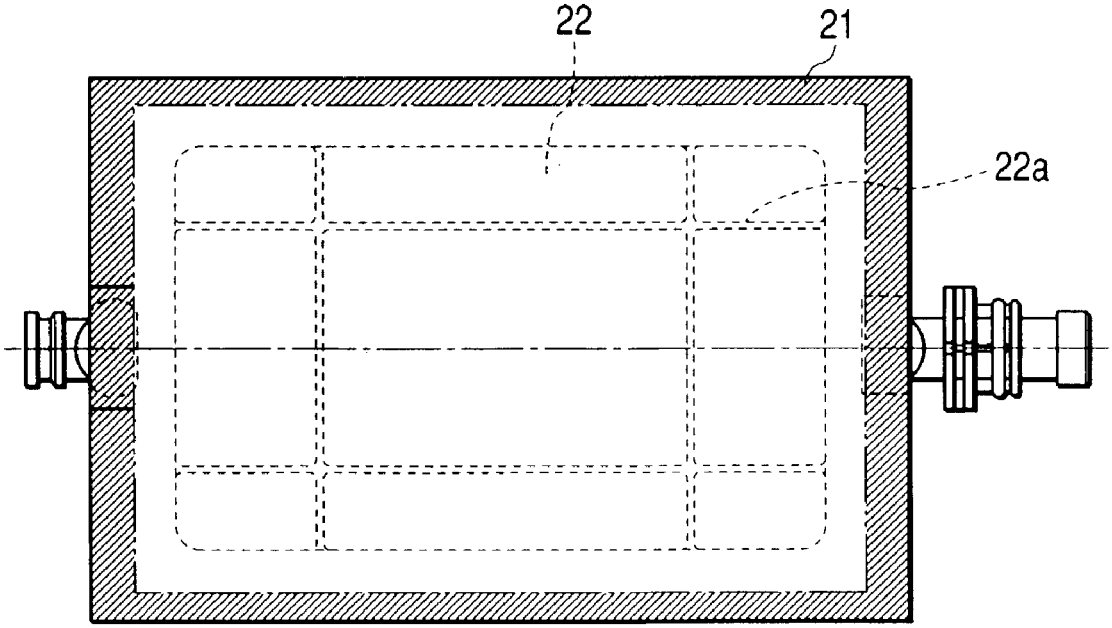
FIG. 7B is a plan view showing the layout state of the adhesion guard in the subtank.

As shown in FIG. 7B, the adhesion guard 22 is a rectangular plastic plate that is slightly smaller than the inner shape of the ink pack 21. As shown in FIG. 6B, on one surface of the adhesion guard 22, grid-like grooves 22*a* having a rectangular cross-section are formed, and on the other surface of the adhesion guard 22, as shown in FIG. 6D, grooves 22*a* having the similar rectangular cross-section are formed crosswise.

As shown in FIGS. 7A and 7B, the adhesion guard 22 is housed in the ink pack 21 in a free state. Since the inner surface of the ink pack 21 does not interfere with the adhesion guard 22 when it expands or contracts by filling or consumption of ink, the error operation of the ink amount detector 23 can be prevented. Further, since the ink supplied from the main tank 10 flows along the grooves 22*a* into the ink pack 21, the ink pack 21 can be initially filled with the ink smoothly.

Figure 8A:
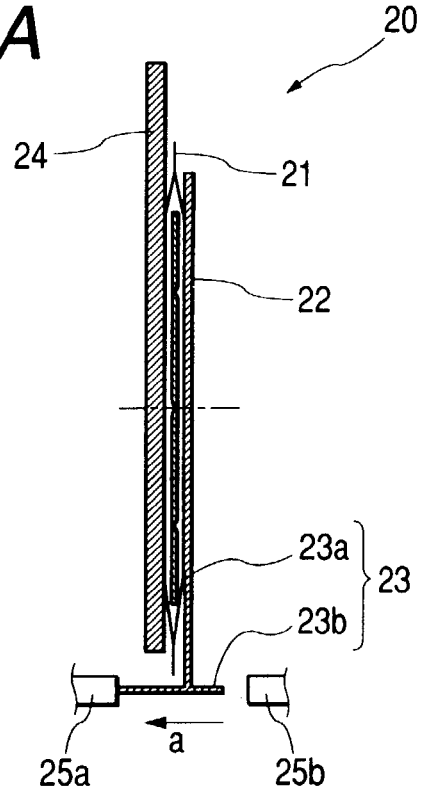
FIGS. 8A and 8B are section views showing the operation of an ink amount detector of the subtank.
Figure 8B:
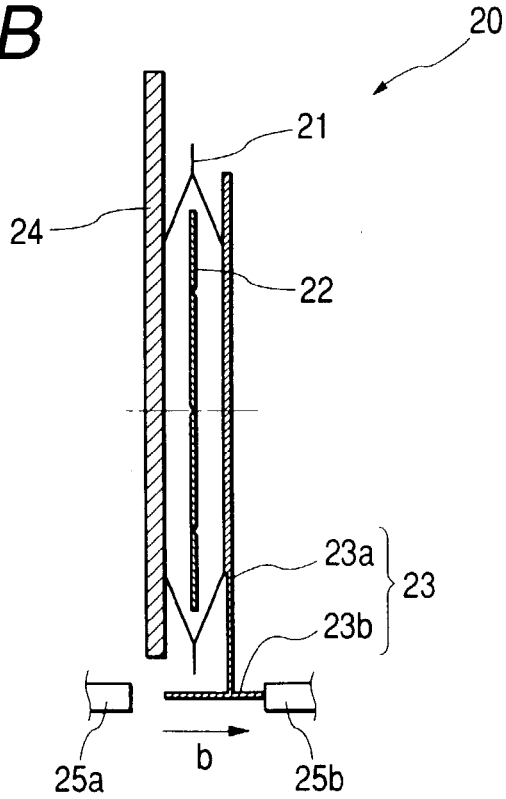

As shown in FIGS. 8A and 8B, switches 25*a* and 25*b* are arranged on both sides of the detector part 23*b* of the ink amount detector 23, that is, on both sides in the direction where the ink pack 21 expands or contracts in accordance with the ink amount stored therein. The switch 25*a* is activated when the ink pack 21 is contracted, by the detector part 23*b* moving in an arrow-a direction, so that it is that the ink pack 21 becomes substantially empty (an ink low state), for example, the amount of ink left therein is 10 g or less.

On the other hand, the switch 25*b* is activated when the ink pack 21 is expanded, by the detector part 23*b* moving in an arrow-b direction, so that it is detected that the ink pack 21 becomes substantially full (an ink full state), for example, the amount of ink therein is 20 g or more. A state where both the switches 25*a* and 25*b* are not activated, that is, a state where the ink amount in the ink pack 21 is between the ink low state and the ink full state is an ordinary state.

Figure 9A:
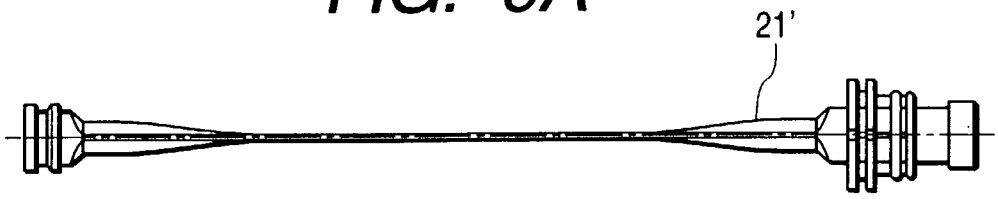
FIG. 9A is a side view showing a modified example of the subtank.
Figure 9B:
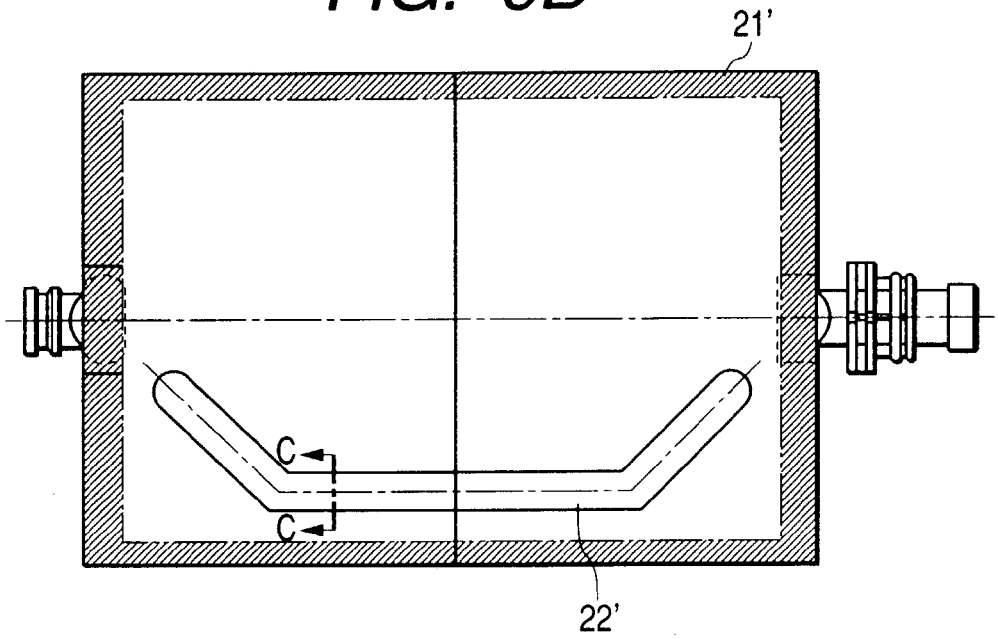
FIG. 9B is a plan view showing the modified example of the subtank.

An ink pack 21' shown in FIGS. 9A and 9B as a modified example is not provided with the rectangular plate-shaped adhesion guard 22, but a adhesion guard 22' formed as a convex having a semi-circular cross-section by press-molding on one surface of the ink pack 21 to which the ink amount detector 23 is bonded. Since the adhesion guard 22' is formed by thus deforming one surface of the ink pack 21, it is not necessary to prepare the rectangular adhesion guard 22 that is a separate member from the ink pack 21. Further, since the adhesion guard 22' can be formed simultaneously with formation of the ink pack 21', a cost of the subtank 20 can be reduced.

Figure 9C:
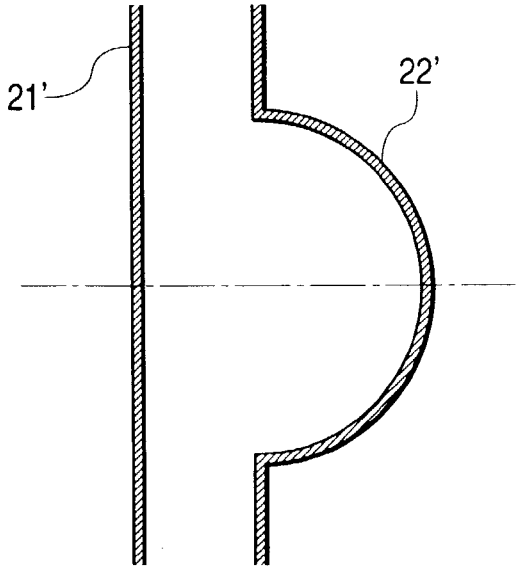
FIG. 9C is an enlarged section view taken along a line C—C in FIG. 9B.

As described above, the rectangular plate-shaped adhesion guard 22, as shown in FIG. 4B, is housed in the ink pack 21 in the free state, and the adhesion guard 22' having the semi-circular and convex section, as shown in FIG. 9C, is formed so as to avoid the bonding surface of the bonded part 23*a* of the ink amount detector 23 to the one surface of the ink pack 21'. Therefore, each of the adhesion guards 22 and 22' does not interfere with the detector part 23*b* of the ink amount detector 23. Accordingly, since the ink amount in the ink packs 22 and 22' can be always detected with high accuracy, bad printing due to a shortage of ink supply can be prevented.

Figure 10:
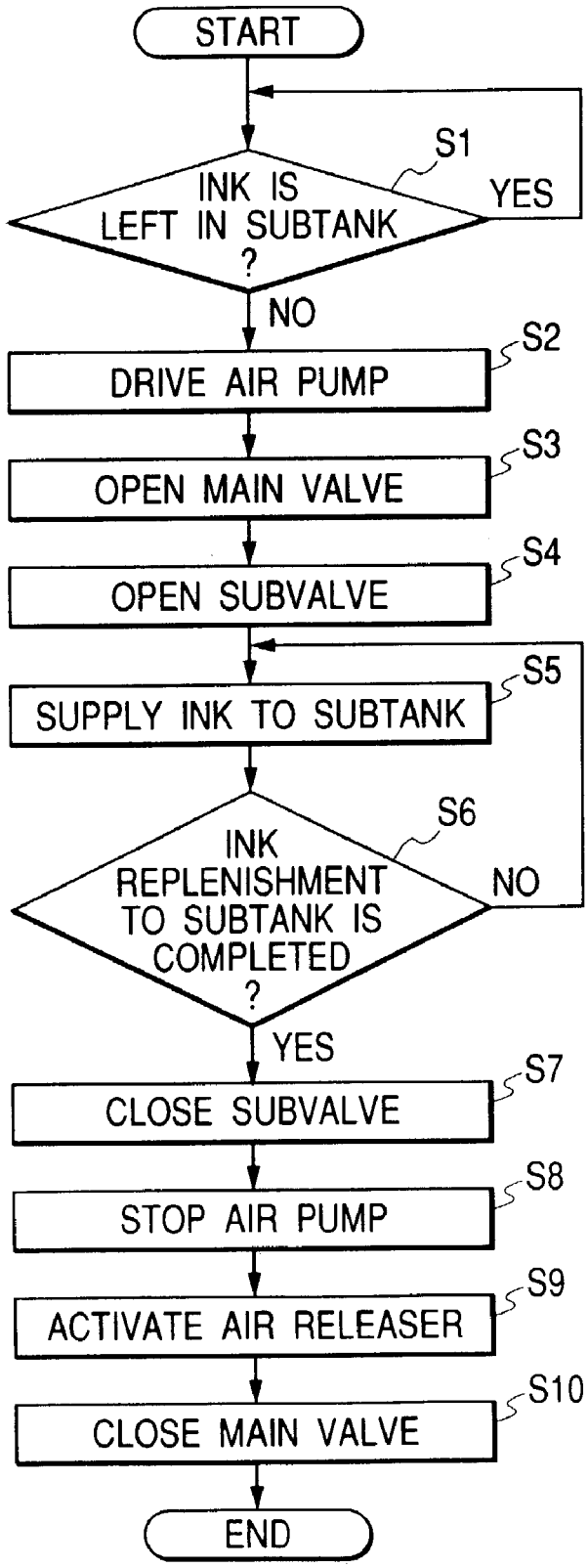
FIG. 10 is a flowchart showing an ink replenishing operation performed in the ink jet recording apparatus.

An ink replenishing operation performed in the thus configured recording system 100 will be described with reference to FIG. 10. The system controller 14, upon reception of a print command from a host computer (not shown), sends the command to the controller 1*a* of each printer 1 so that the controller 1*a* of each printer 1 starts a print processing on the basis of the received print command. First, it is checked the amount of the residual ink in the subtank 20 (step S1).

When the controller 1*a* of one printer 1 detects the small amount of the residual ink in the subtank 20, it is notified to the system controller 14. Then, the system controller 14 drives the air pump 12 (step S2), opens the main valve 17 (step S3), and opens the subvalve 18 through the controller 1*a* of the printer 1 (step S4).

The air pump 12 supplies air to the air chamber 10*a* of the main tank 10 thereby to pressurize the ink in the ink pack 10*b* of the main tank 10, and supplies the ink to the subtank 20 of the printer 1 thereby to replenish the subtank 20 with the ink (step S5). Hereby, since it is possible to prevent the ink in the subtank 20 from running short, the ink can be sufficiently supplied to the plural printers 1 that consume a large amount of ink.

Thereafter, when the controller 1*a* of the printer 1 detects the completion of ink replenishment in the subtank 20 (step S6), it is notified to the system controller 14. Then, the system controller 14 closes the subvalve 18 through the controller 1*a* of the printer 1 (step S7), stops drive of the air pump 12 (step S8), activates the air releaser 19 to open the insides of the pipe line 16 and the air chamber 10*a* to atmosphere so that the pressurized state produced by the air pump 12 (step S9) is canceled. Lastly, the main valve 17 (step S10) is closed.

Since the pressurized state can be canceled by the air releaser 19 when the ink supply is not required, breakdown of the apparatus caused by keeping of the pressurized state can be eliminated, reliability can be improved. Moreover, safety can be secured even if a pressurizing control error or an ink supply error is occurred.

The above operation is repeated while the ink jet recording system 100 is activated. When the system controller 14 detects the small amount of the residual ink in the ink pack 10*b* of the main tank 10, it is notified to the host computer through a display or the like. Hereby, the user replaces the subject ink pack 10*b* with a new one.

Accordingly, since the user manages only the ink in the ink pack 10*b* of one main tank 10, the residual amount check of ink is facilitated. Further, since the pipe line 15 from the main tank 10 to the subtank 20 can be closed by the main valve 17 on the main tank 10 side, the ink pack 10*b* of the main tank 10 can be replaced even during the printing operation, without causing the air invasion or ink leakage in the pipe line 15.

Since the ink is forcedly supplied to each subtank 20 by the air pump 12, and the head difference between the subtank 20 and the recording head 5 and the pipe line 20*a* in each printer 1 are arranged such that the ink supply from the subtank 20 to the recording head 5 can be stably performed, the printers 1 can be arranged in the horizontal direction, the vertical direction, or three-dimensionally (their combination), even if the main tank is arranged in any position. In a case where the printers 1 are arranged in the vertical direction, the layout space of the plural printers 1 can be reduced. In other words, the number of printers per a unit area can be increased.

Figure 11:
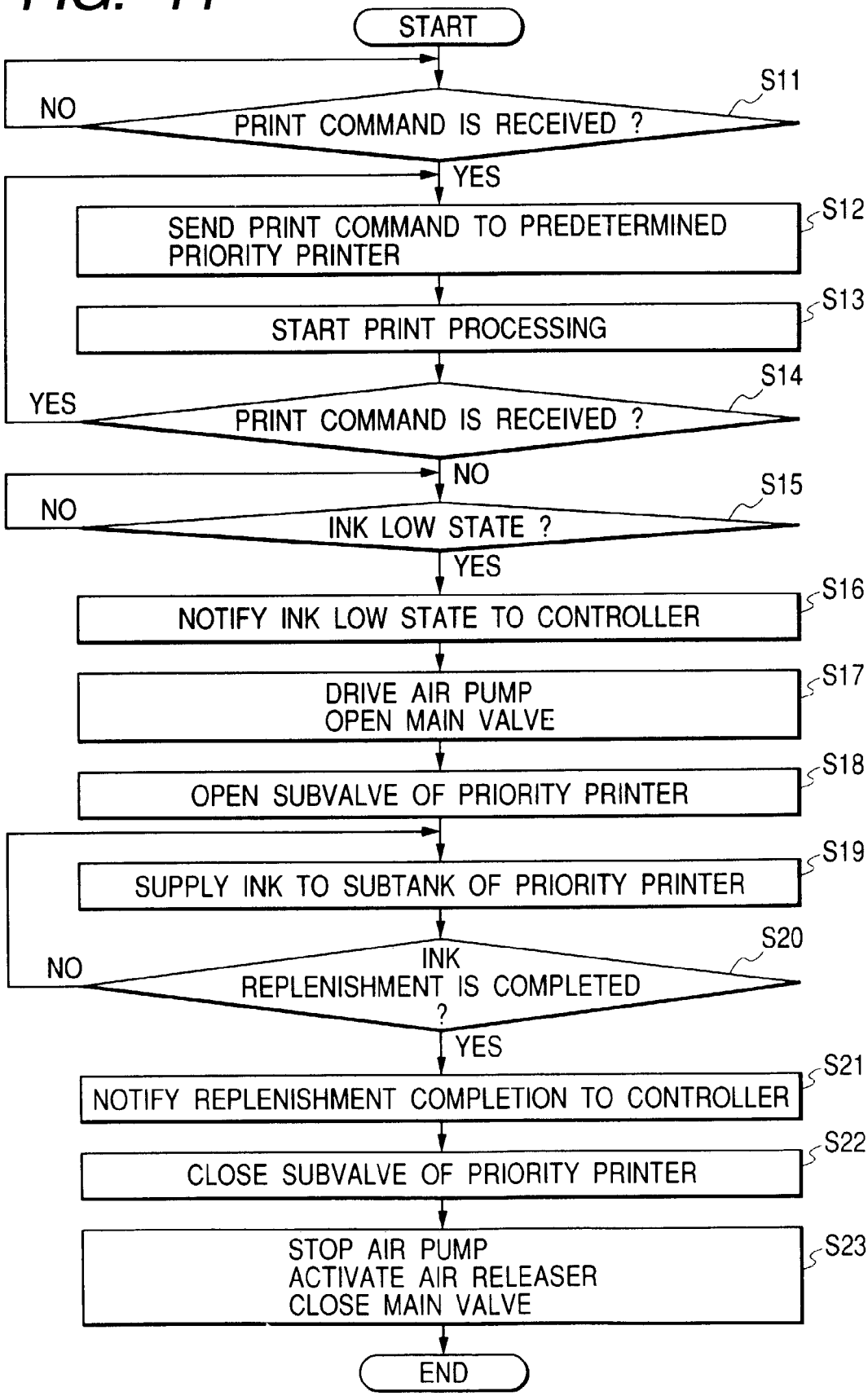
FIG. 11 is a flowchart showing another ink replenishing operation performed in the ink jet recording apparatus.

Alternatively, another ink replenishing operation shown in FIG. 11 may be adopted. The system controller 14, upon reception of a print command, for example, from a host computer (not shown) (step S11), sends the print command to a controller 1*a* of a printer 1 in which the ink supplying time from the main tank 10 to the printer 1 is shortest, that is, a printer 1 in which a length of the pipe line 15 connecting the main tank 10 and the printer 1 is shortest (hereinafter referred to as a first priority printer) (step S12). Then, the controller 1*a* of the first priority printer 1 starts a printing operation on the basis of the received print command, and checks the amount of the residual ink in the subtank 20 (step S13).

Further, the system controller 14, upon reception of a print command from the host computer (step S14), sends the print command to a controller 1*a* of a printer 1 in which a length of the pipe line 15 connecting the main tank 10 and the printer 1 is secondly shortest (hereinafter referred to as a second priority printer) (step S12). Then, the controller 1*a* of the second priority printer 1 starts a printing operation on the basis of the received print command, and checks the amount of the residual ink in the subtank 20 (step S13). Hereafter, a third priority printer, a fourth priority printer . . . are similarly controlled (steps S11 to S14).

Since the printers 1 are sequentially controlled in accordance with the priority based on the ink supplying time (the length of the pipe line 15), in a case where the printing amount increases, the somewhat large amount of printing can be assigned to the printer 1 in which the ink supply completes quickly (i.e., a higher priority printer). Therefore, the total ink supply time can be reduced.

When the controller 1*a* of the first priority printer 1 that is most preferentially controlled checks whether the amount of the residual ink in the subtank 20 comes to the small amount, namely, whether the subtank 20 is in the ink low state (step S15). When the ink low state is detected, it is notified to the system controller 14 (step S16). Then, the system controller 14 drives the air pump 12, opens the main valve 17 (step S17), and further opens the subvalve 18 through the controller 1*a* of the first priority printer 1 (step S18).

The air pump 12 supplies air to the air chamber 10*a* of the main tank 10 thereby to pressurize ink in the ink pack 10*b* of the main tank 10, and supplies the ink to the subtank 20 of the first priority printer 1 thereby to replenish the subtank 20 with the ink (step S19). Thereafter, the controller 1*a* of the first priority printer 1, when detects the completion of ink replenishment in the subtank 20 (step S20), notifies that to the system controller 14 (step S21).

Then, the system controller 14 closes the subvalve 18 through the controller 1*a* of the above printer 1 (step S22), stops drive of the air pump 12, activates the air releaser 19 to open the insides of the pipe line 16 and the air chamber 10*a* to the atmosphere so that the pressurized state produced by the air pump 12 is released. Lastly the controller 1*a* closes the main valve 17 (step S23). Hereafter, the ink is similarly supplied to the second priority printer, the third priority printer . . . (steps S15 to S23)

The above operation is repeated while the ink jet recording system 100 is activated. When the system controller 14 detects the ink low state of the ink pack 10*b* of the main tank 10, it is notified to the host computer through a display or the like. Hereby, the user replaces the ink pack 10*b* of the subject ink tank 10 for a new one.

Also according to the above configuration, the same advantages discussed with reference to FIG. 10 can be attained.

Here, the air pump 12 may be removed. In such a configuration, a main tank 10 is arranged at the top of the system, and each of printers 1 is arranged below the main tank 10 with difference of height. Due to the head difference between the main tank 10 and the subtank 20 of each printer 1, by opening the main valve 17, the ink can be surely supplied to the subtank in which the subvalve 18 is opened.

Figure 12:
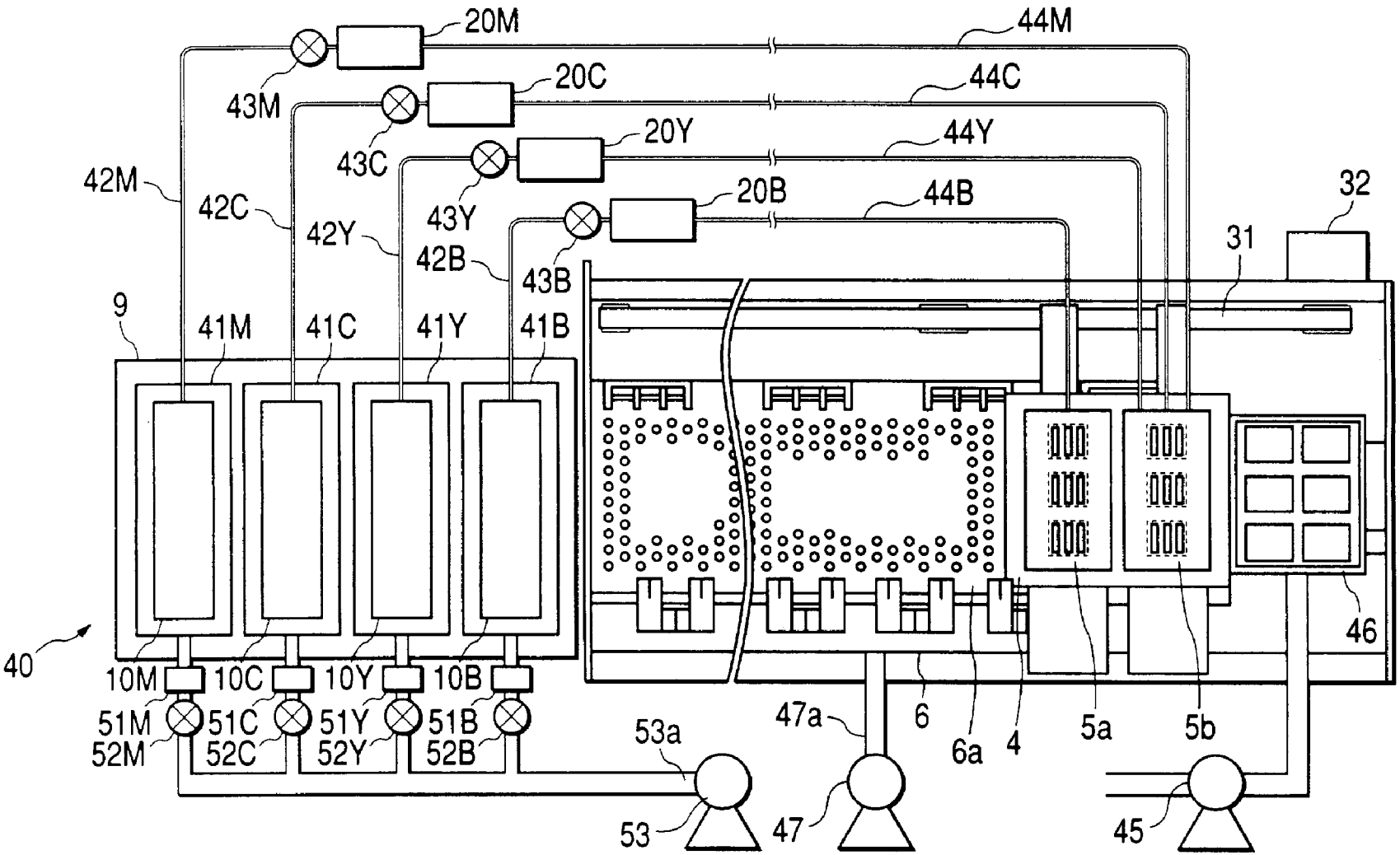
FIG. 12 is a diagram showing the schematic constitution of the ink jet recording apparatus according to a second embodiment of the invention.

In an ink jet recording system according to a second embodiment of the invention, as shown in FIG. 12, a carriage 4 is constituted so that it can be reciprocated by a carriage drive motor 32 through a timing belt 31. On this carriage 4, a recording head 5*a* that ejects a droplet of black ink supplied from an ink supply system 40 and a recording head 5*b* that ejects a droplet of each color ink of yellow, cyan, and magenta are mounted.

The ink supply system 40 includes: main tanks 10B, 10Y, 10C and 10M in which ink of each color is stored; subtanks 20B, 20Y, 20C and 20M in which the ink of each color supplied from the main tanks 10B, 10Y, 10C and 10M are temporarily stored; and pressure chambers 41B, 41Y, 41C and 41M that are arranged in the ink tank container 9 for housing the main tanks 10B, 10Y, 10C and 10M therein. The respective pressure chambers 41B, 41Y, 41C and 41M are connected to an ejection port 53*a* of a pressure pump 53 through pressure detectors 51B, 51Y, 51C and 51M and electromagnetic valves for pressure release 52B, 52Y, 52C and 52M (hereinafter, releaser valves).

There are provided pipe lines 42B, 42Y, 42C and 42M that connect the main tanks 10B, 10Y 10C and 10M with the subtanks 20B, 20Y, 20C and 20M. Electromagnetic valves 43B, 43Y, 43C and 43M (hereinafter, simply referred as valves) connected to the pipe lines 42B, 42Y 42C and 42M; and ink supplying tubes 44*b*, 44Y, 44C and 44M that connects the subtanks 20B, 20Y, 20C and 20M to the recording heads 5*a* and 5*b*.

In a non-printing region on a right side of a sheet guide member 6, a capping unit 46 is arranged, which causes a suction pump 45 to apply negative pressure to the recording heads 5*a* and 5*b* for preventing the clogging caused by dried ink in the recording heads 5*a*, 5*b* at the non-printing time or initial ink filling time of the recording heads 5*a* and 5*b*.

Figure 13:
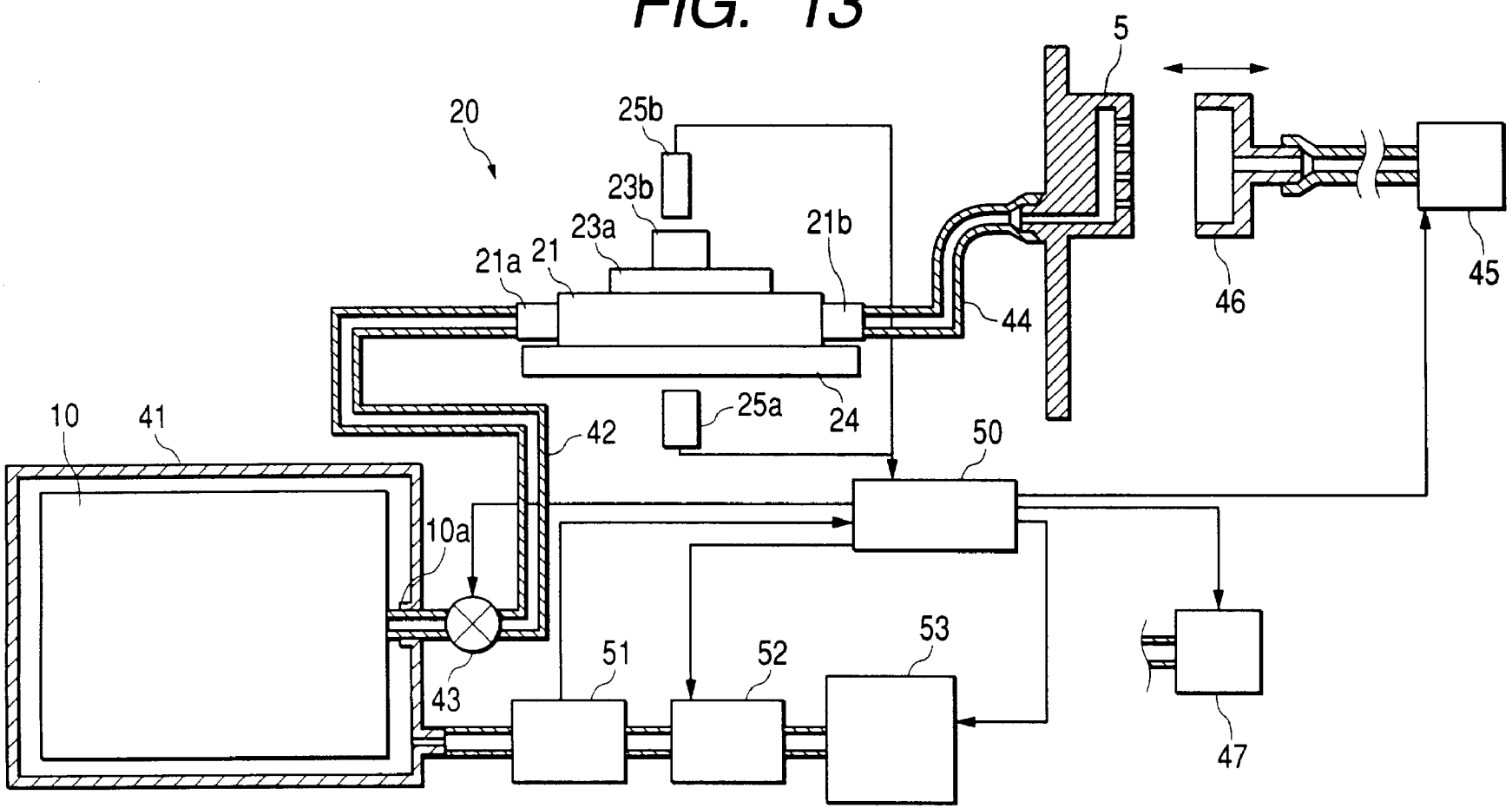
FIG. 13 is a diagram showing the detailed constitution of a recording section of the ink jet recording apparatus in FIG. 12.

As is specifically shown in FIG. 13, in the main tank 10 (10B, 10Y, 10C. 10M), a connection port 10*a* is connected to the pipe line 42 (42B, 42Y, 42C. 42M). In the subtank 20 (20B, 20Y, 20C, 20M), an Inlet 21*a* is connected to the pipe line 42, and an outlet 21*b* is connected to the ink supplying tube 44 (44*b*, 44Y, 44C, 44M).

A controller 50 is electrically connected to: the pressure detector 51 (51B, 51Y, 51C, 51M) that detects the pressure applied to the main tank 10; the releaser valve 52 (52B, 52Y, 52C, 52M); the pressure pump 53; the valves 43 (43B, 43Y, 43C, 43M); switches 25*a*, 25*b* activated by displacement of an ink amount detector 23 provided with the subtank 20; and suction pumps 45 and 47. The controller 50 controls check of the amount of ink in the main tank 10 and in the subtank 20, drives of the suction pumps 45, 47 and the pressure pump 53, and opens or closes the valves 43 and 52. In FIG. 13, for convenience, the main tank 10, the subtank 20, the pressure chamber 41, the pipe line 42, the valve 43 and the ink supplying tube 44 are not shown every each color ink, but shown for only one color ink.

An initial ink filling operation performed in the recording system will be described with reference to flowcharts of FIGS. 13 to 18. In the initial state, the valves 43 for all the colors are closed. Further, in the subtanks 20 for all the colors, air and carrier liquid entering in an assembly process has entered. Firstly, the controller 50, upon reception of an initial filling command from a host computer (not shown), exhausts the air and carrier liquid in each subtank 20 (step S101 in FIG. 14).

Namely, the recording head 5 is moved to the non-printing region to seal the recording head 5 with the capping unit 46. Next, the suction pump 45 is operated to apply the negative pressure of the capping unit 46 through the recording head 5 to each ink supplying tube 44 and each subtank 20, and the air and the carrier liquid that remain in these members are exhausted to the capping unit 46.

The suction amount of the suction pump 45 at this time is set to not a fixed value but a variable value varying according to the amount of ink in each subtank 20. Namely, the control unit judges whether the amount of ink in each subtank 20 is 10 g or less, (step S111 in FIG. 15), that is, whether the ink amount is in an ink low state. When the ink amount is not in the ink low state, the controller 50 sets the suction amount of the suction pump 45 to a small amount, for example, 1 g, and drives the suction pump 45 till the subtank 20 enters in the ink low state (step S112 in FIG. 15). In this time, since the carrier liquid enters in each subtank 20 in place of ink, the controller performs judgment from the amount of carrier liquid.

When the amount of the carrier liquid in each subtank 20 comes to the ink low state, the controller 50 sets the suction amount of the suction pump 45 to a large amount, for example, 100 g, and drives the suction pump 45 thereby to make each subtank 20 in a high negative pressure state. Accordingly, each subtank 20 is compressed by atmospheric pressure thereby to completely exhaust the air and the carrier liquid to the capping apparatus 46 (step S113 in FIG. 15).

In a case where the suction amount of the suction pump 45 is set to a considerably large value, its suction amount may be set as a fixed value. Further, a threshold value of the number of loops between the steps S111 and S112 may be previously set in case the loops are excessively repeated due to some trouble. When the number of loops is over the threshold value, the operation proceeds to the step S113.

Figure 14:
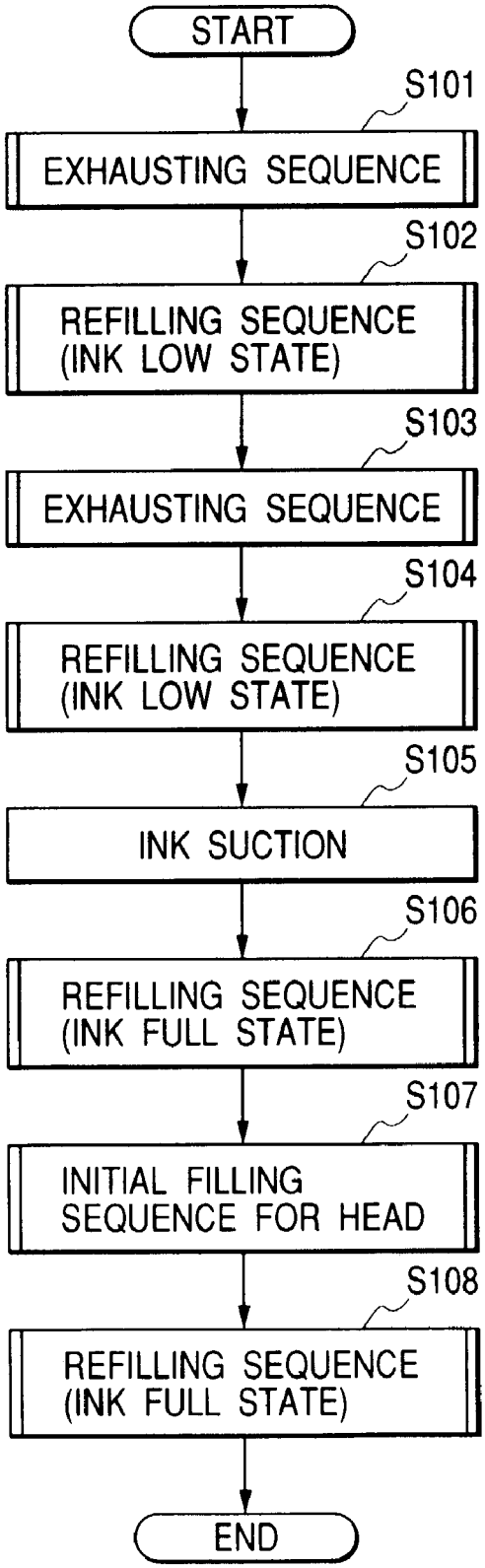
FIG. 14 is a flowchart showing an initial ink filling operation performed in the recording section in FIG. 13.
Figure 15:
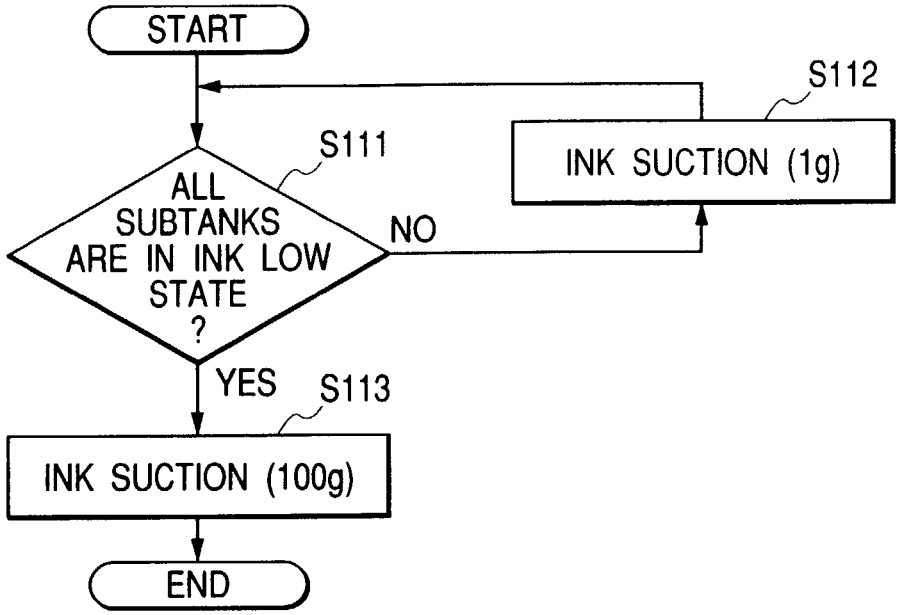
FIGS. 15 to 18 are first flowcharts showing the detailed operations in the initial ink filling operation.
Figure 16:
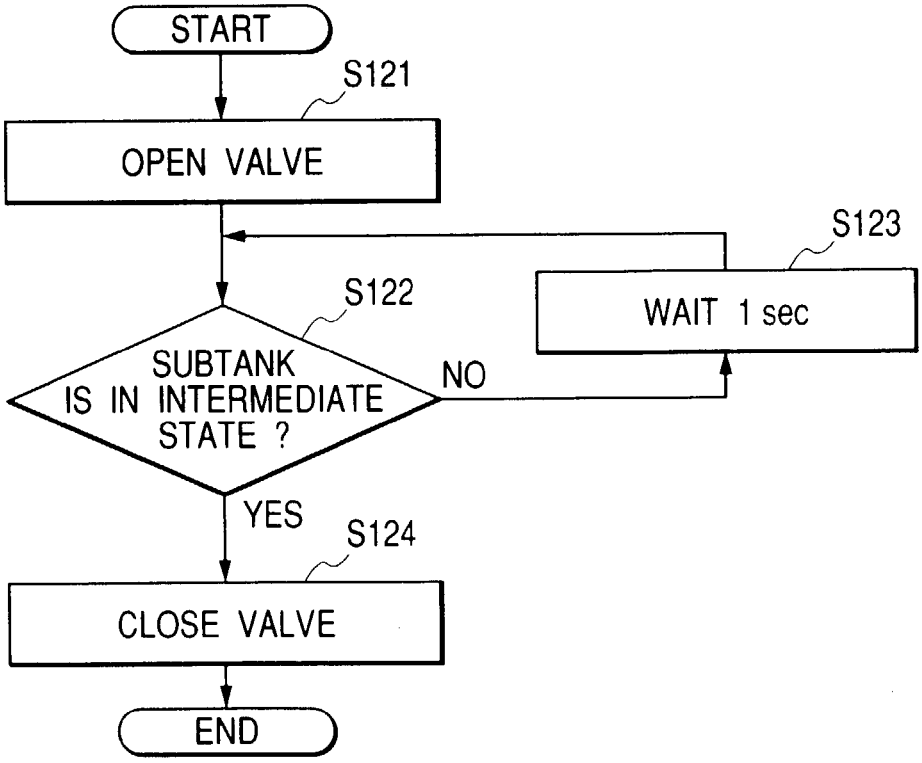

Next, the controller 50 supplies ink in each main tank 10 to each subtank 20 (step S102 in FIG. 14). Namely, the controller 50 opens each valve 43, and allows the ink in each main tank 10 to flow into each subtank 20 that is in the high negative pressure state (step S121 in FIG. 16). Next, the controller 50 judges whether the amount of ink in each subtank 20 is in a state between the ink low state and an ink full state (an intermediate state), for example, 20 g or more (step S122 in FIG. 16). When the ink amount is not the intermediate state, the controller 50 waits for one second (step S123 in FIG. 16). Hereby, the amount of ink in each subtank 20 increases gradually, and when it comes to the intermediate state, the controller 50 closes each valve 43 (step S124 in FIG. 16).

In this embodiment, the pressure pump 53 operates thereby to pressurize each main tank 10. However, in a system in which each main tank 10 is not pressurized since each subtank 20 is in the high negative pressure state, priming to each sub-subtank 20 is performed by this negative pressure and each pipe line 42 can be filled with the ink, so that the ink supply from each main tank 10 to each subtank 20 can be performed.

Further, enough time period for the amount of ink in each subtank 20 to come to the intermediate state may be previously set in case where a loop between the steps S122 and S123 is excessively repeated due to some trouble. In a case where the time when the ink amount has come to the intermediate state is over the preset time period, the operation proceeds to the step S124 forcedly. However, in this case, even if the ink is not supplied from each main tank 10 to each subtank 20, the initial filling is continued. Therefore, in order to prevent this situation, a fetal error (breakdown) or an ink end error (state where there is no ink in each main tank 10) may be established when the time period for which the ink amount has come to the intermediate state is over the preset time period.

Here, since the ink supplied from each main tank 10 to each subtank 20 includes air that has existed in each pipe line 42, this air must be also exhausted. Therefore, the controller 50 exhausts the air and the ink in each subtank 20 (step S103 in FIG. 14). Namely, the suction pump 45 is operated thereby to apply the negative pressure of the capping device 46 to each ink supplying tube 44 and each subtank 20 through the recording head 5, so that the air and the ink in these members are exhausted to the capping unit 46.

Namely, the operations explained with reference to FIGS. 15 and 16 are again executed to completely exhaust the air and the ink to the capping unit 46. In order to exhaust the air contained in the ink in each subtank 20 more completely, the steps S103 and S104 may be repeated plural times.

Here, in a case where each valve 43 is opened when each subtank 20 is in the high negative pressure state, the ink flows suddenly from each main tank 10 to each subtank 20 and bubbles, so that the deaeration lowers. Therefore, the controller 50 exhausts the bubbling ink in the ink in each subtank 20, for example, 30–80%, preferably 50% of the total ink amount. Namely, the suction pump 45 is operated to suck the ink in each subtank 20 and exhaust it to the capping unit 46 (Step S105 in FIG. 14).

Next, the controller 50 supplies the ink in each main tank 10 to each subtank 20 (step S106 in FIG. 14). Namely, the controller 50 opens each valve 43, and allows the ink in each main tank 10 to flow into each subtank 20 (step S131 in FIG. 17). Next, the controller 50 judges whether the amount of ink in each subtank 20 is in the ink full state (step S132 in FIG. 17). When the ink amount is not in the ink full state, the controller 50 waits for one second (step S133 in FIG. 17).

Figure 17:
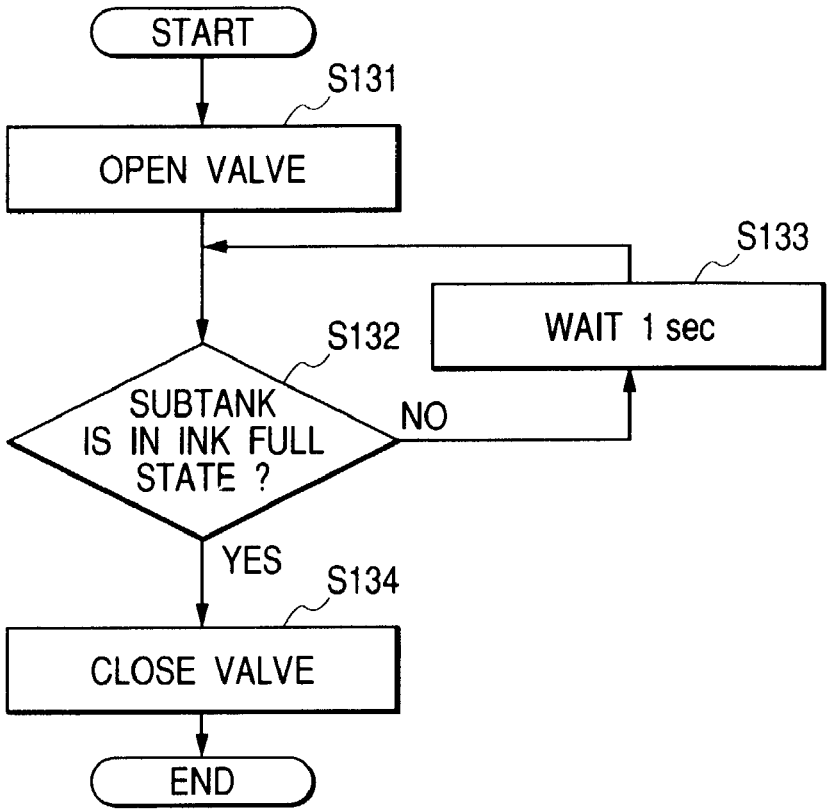

When the amount of ink in each subtank 20 comes to the ink full state, the controller 50 closes each valve 43 (step S134 in FIG. 17). In the step S131, since each subtank 20 is not in the negative pressure state, the ink stored therein does not bubble. Hereby, the ink that has bubbled in each subtank 20 can be completed exhausted, and, with ink supplied till the ink amount comes to the ink full state, the aerated ink can be diluted.

Here, in order to secure print quality immediately after the initial filling, since it is necessary to dissolve in the ink the air bubbles remaining in a portion in the recording head 5 where the flow stagnates, the predetermined amount of deaerated ink must be allowed to flow. Therefore, the controller 50 performs an initial ink filling operation for the recording head 5 (step S107 in FIG. 14). Namely, the suction pump 45 is operated thereby to suck and exhaust 50% of the total ink amount in each subtank 20 to the capping unit 46 (step S141 in FIG. 18).

Figure 18:
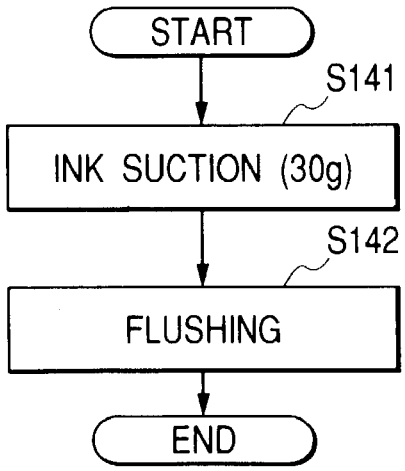

And, the controller 50 performs a flushing operation of ejecting the ink in the capping unit 46 by driving the recording head 5 (step S142 in FIG. 18). Hereby, the minute air bubbles stuck around an actuator of the recording head 5 separate from the actuator and dissolve. Further, at the flushing time, it is not necessary to seal the recording head 5 with the capping unit 46, but the recording head 5 may be only positioned on the capping unit 46.

Next, the controller 50, in order to compensate the ink consumed by the initial filling in the recording head 5, supplies ink in each main tank 10 to each subtank 20 (step S108 in FIG. 14). Namely, the operations explained with reference to FIG. 17 is again executed.

By the above steps, the initial filling processing in each subtank 20 and the initial filling processing in the recording head 5 are completed. The steps S105,S106 and the steps S107,S108 may be performed according to necessity.

In this embodiment, the ink jet printer 1 has one subtank 20 for one main tank 10. However, the invention can be applied also to an ink jet recording apparatus having plural subtanks 20 (recording heads 5) for one main tank 10, which will be described below as a third embodiment.

Figure 19:
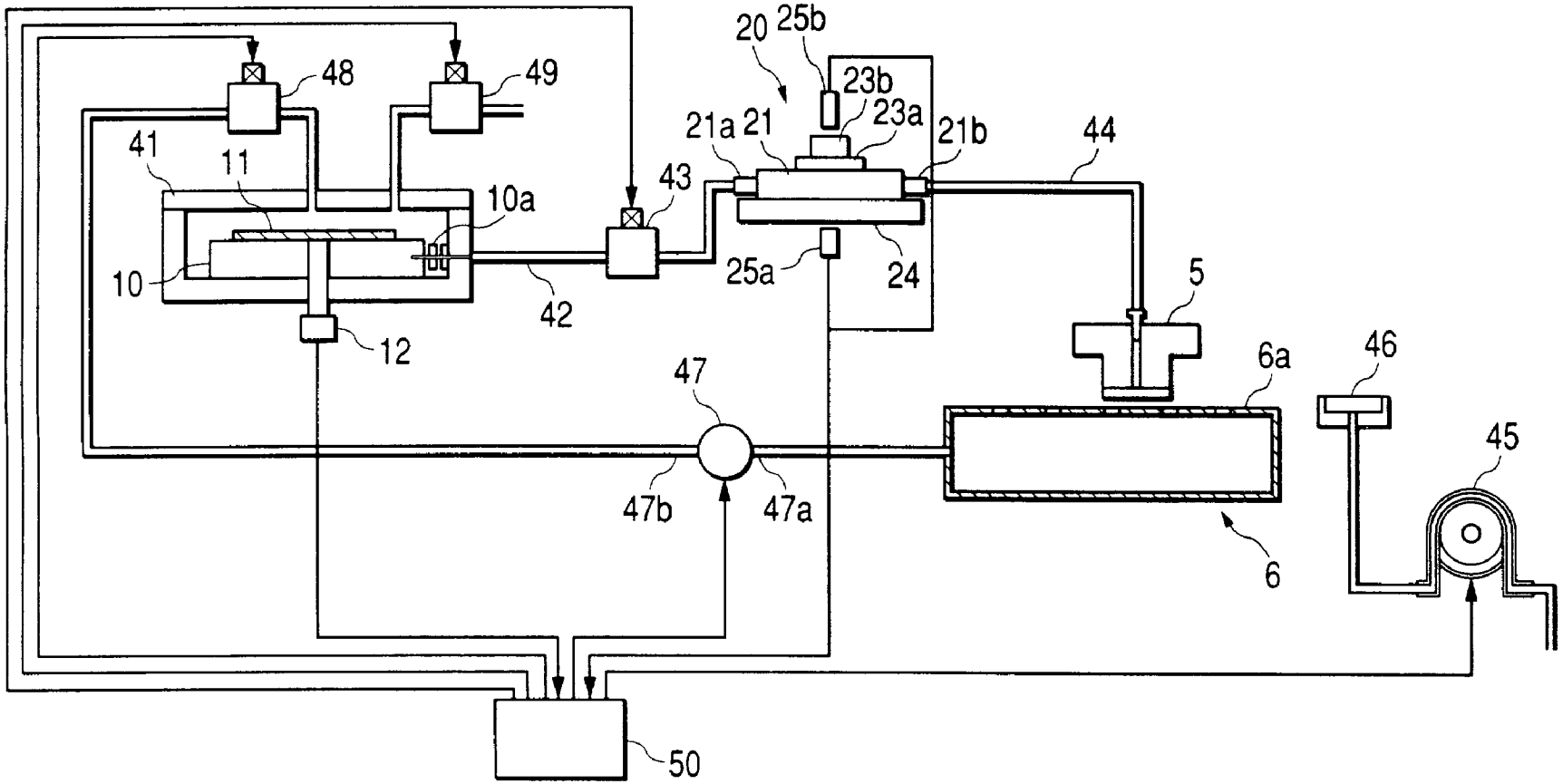
FIG. 19 is a diagram showing the detailed constitution of a recording section of an ink jet recording apparatus according to a third embodiment of the invention.

In FIG. 19, parts having the same constitution as the constitution shown in FIG. 13 are denoted by the same reference numerals, and their detailed explanation is omitted. A main tank 10, to which an residual ink amount detector plate 11 is attached, is housed in a pressure chamber 41 (41B, 41Y, 41C, 41M). The pressure chamber 41 is connected through an electromagnetic valve 48 (48B, 48Y, 48C, 48M; hereinafter referred as a main valve) to an outlet port 47*b* of a suction pump 47 in order to arbitrarily adjust pressure therein, and connected through an electromagnetic valve 49 for pressure release (hereinafter referred as a releaser valve). An inlet port of the suction pump 47 is connected to a paper guide 6 to fix a print paper thereon. An electromagnetic valves 43 (43B, 43Y, 43C and 43M; hereinafter, referred as a subvalve) is connected to a pipe line 42 (42B, 42Y, 42C and 42M).

A controller 50 is electrically connected to: a detector 12 that detects movement of the residual ink amount detector plate 11 of the main tank 10; switches 25*a* and 25*b* that operate by the movement of an ink amount detector 23 provided with a subtank 20; each of valves 43, 48 and 49; and each of suction pumps 45 and 47. The controller 50 controls check of the amount of residual ink in the main tank 10 and the amount of ink in the subtank 20, drives each suction pumps 45, 47, and opens or closes the respective valves 43, 48 and 49. In FIG. 19, for convenience, the main tank 10, the subtank 20, the pressure chamber 41, the pipe line 42, the subvalve 43 and an ink supplying tube 44 are not shown every each color ink, but shown for only one color ink.

Thus by using air-intake and air-outlet of the suction pump 47, both of fixing of the print paper and pressurization of the main tank 10 are simultaneously performed, so that the pressure pump 53 shown in FIGS. 12 and 13 is not required. The size and cost of the printer 1 can be accordingly downsized.

Figure 20:
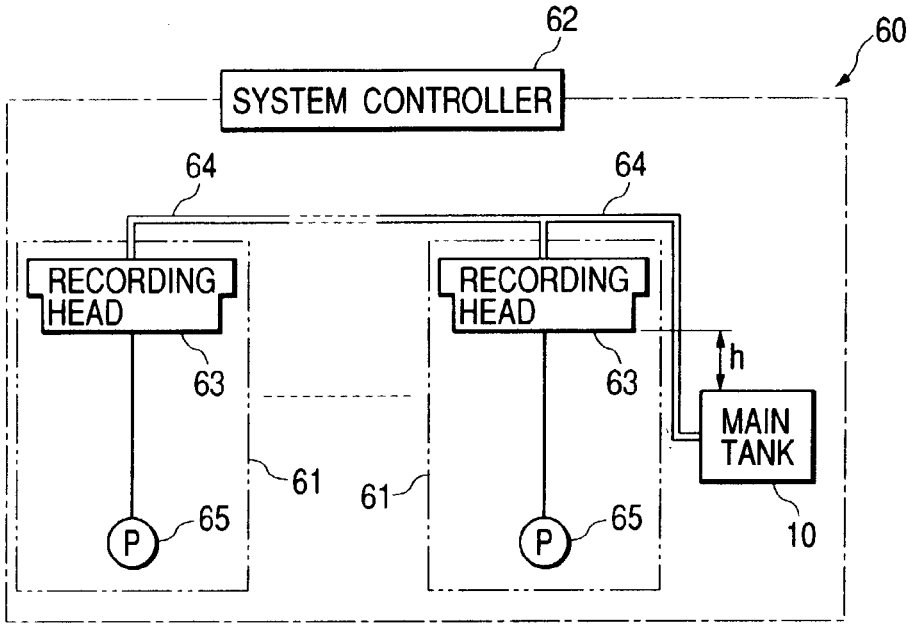
FIG. 20 is a diagram showing the schematic constitution of an ink supply system in an ink jet recording apparatus according to a fourth embodiment of the invention.

FIG. 20 shows an ink supply system 60 in an ink jet recording system according to a fourth embodiment of the invention. This ink supply system 60 includes one main tank 10, plural ink jet printers 61, and a system controller 62 that control the whole of the system.

The main tank 10 is located in a lower position than a recording head 63 of each ink jet printer 61 and arranged so that a head difference h is given between the recording head 63 and the main tank 10. Further, the main tank 10 is connected to each recording head 63 by a pipe line 64 to always supply ink storing therein to each recording head 63 directly. At this time, since the negative pressure state is required in order to make a meniscus of a nozzle of the recording head 63, the head difference between the main tank 10 and each recording head 63 is made constant. By locating the main tank 10 in the lower position than the recording head 63, it is possible to prevent the meniscus formed in the nozzle of each recording head 63 from being damaged.

A suction pump 65 is connected to each recording head 63, and sucks air in the ink flowing passage extending from the nozzle of each recording head 63. According to this constitution, clogging due to dust in the ink flowing passage or clogging due to dried ink in a nozzle opening can be resolved. The system controller 62 monitors the consumed ink amount in each recording head 63 and manages the amount of the residual ink in the main tank 10.

In FIG. 20, for convenient, the main tank 10, the recording heads 63, and the pipe line 64 are not shown every each color ink in a four-color type of black, cyan, magenta and yellow used in color printing, in a six-color type of black, cyan, light cyan, magenta, light magenta and yellow, or in a seven-color type of black, cyan, light cyan, magenta, light magenta, yellow and dark yellow. Actually, the main tank 10 and the recording head 63 are partitioned every each color and they are connected to each other by the pipe line 64 for each color.

Although the ink jet printer 61 includes one recording head 63 that ejects each of the above colors, one ink jet printer 61 may be provided with plural recording heads 63.

Figure 21:
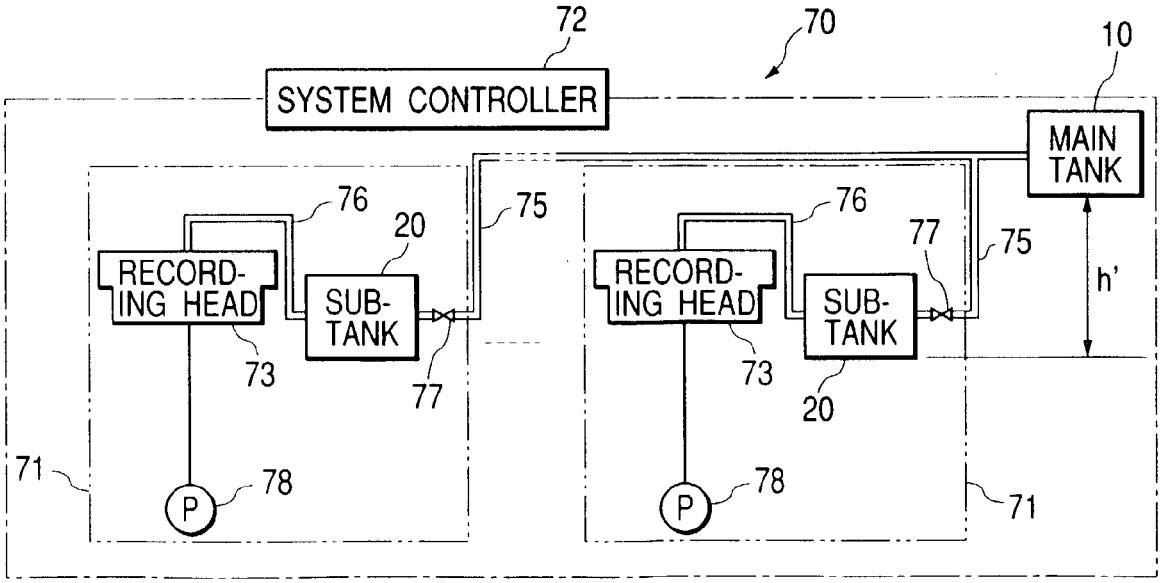
FIG. 21 is a diagram showing the schematic constitution of an ink supply system in an ink jet recording apparatus according to a fifth embodiment of the invention.

FIG. 21 shows an ink supply system 70 in an ink jet recording system according to a fifth embodiment of the invention. This ink supply system 70 includes one main tank 10, plural ink jet printers 71, and a system controller 72 that controls the whole of the system.

Each ink jet printer 71 includes one subtank 20 and one recording head 73. Since the negative pressure state is required in order to make a meniscus of a nozzle of the recording head 73, the head difference between the subtank 20 and the corresponding recording head 73 is made constant.

The main tank 10 is located in the higher position than each subtank 20 so that a head difference h' is given between the main tank 10 and each subtank 20, and connected to each subtank 20 by a pipe line 75. The subtank 20 is connected to the recording head 73 by a pipe line 76. The capacity of the main tank 10 has several times of the total capacity of the subtanks 20. An electromagnetic valve 77 (hereinafter, simply referred as valve) is connected to the pipe line 75. A suction pump 78 is connected to the recording head 73 to apply negative pressure in an ink flowing passage extending from the nozzle of the recording head 73, thereby to decompress ink in the main tank 10. In cooperation with the head differential pressure, the ink is once led into the subtank 20.

After the recording head 73 is replenished with ink in the subtank 20, the system controller 72 closes the valve 77 and ejects the ink from the recording head 73 thereby to execute printing. For this time, the system controller 72 monitors the amount of ink in each subtank 20, and replenishes each subtank 20 with ink in the main tank 10.

Figure 22:
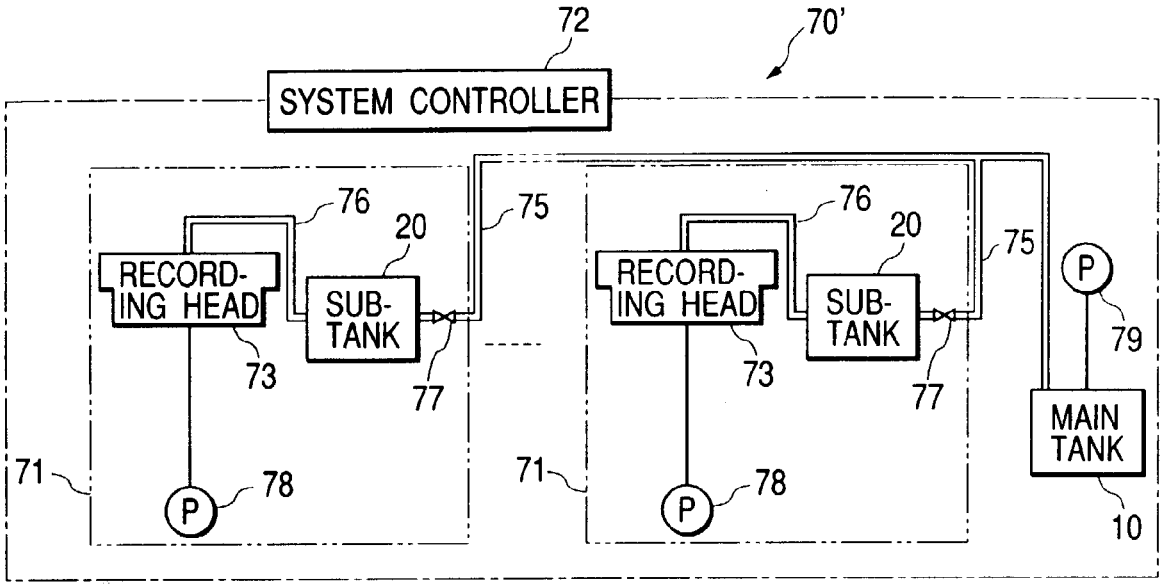
FIG. 22 is a diagram showing the schematic constitution of an ink supply system in an ink jet recording apparatus according to a sixth embodiment of the invention.

As in FIG. 22 which shows an ink supply system 70' in an ink jet recording system according to a sixth embodiment of the invention, an air pump 79 may be connected to a main tank 10 to compress ink in the main tank 10 to replenish the subtanks 20. According to this configuration, ink can be supplied to the subtank 20 more quickly than the system in FIG. 21. Moreover, the layout position of the main tank 10 is not limited as in the system in FIG. 21.

Figure 23:
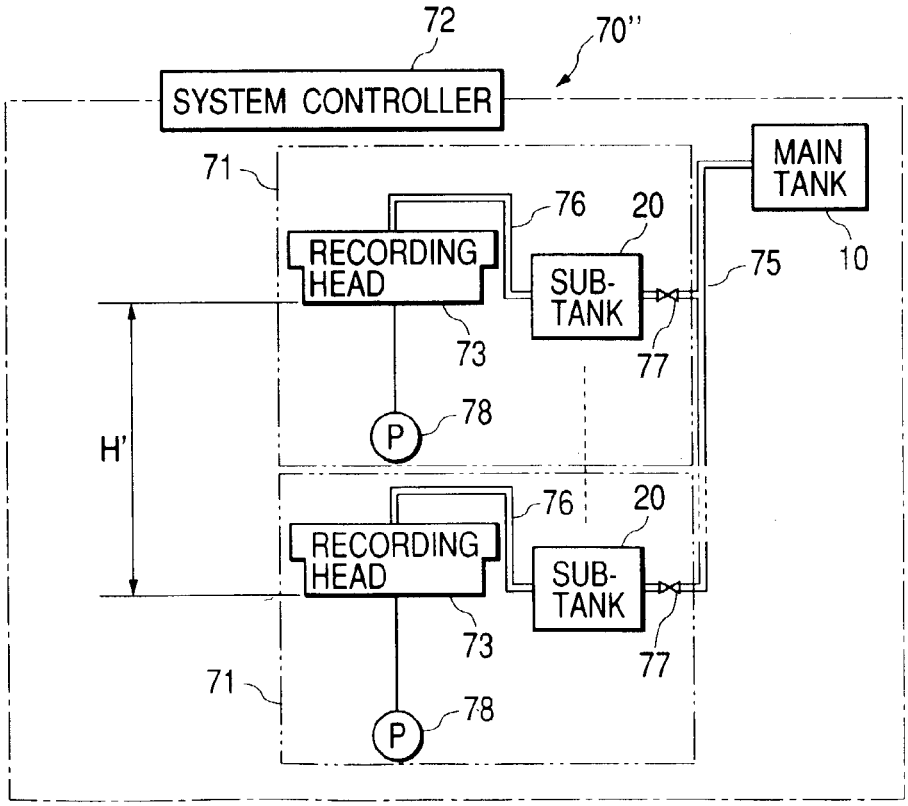
FIG. 23 is a diagram showing the schematic constitution of an ink supply system in an ink jet recording apparatus according to a seventh embodiment of the invention.

As in FIG. 23 which shows an ink supply system 70"in an ink jet recording system according to a seventh embodiment of the invention, ink jet printers 71 may be arranged vertically to reduce the layout area of the system. A main tank 10 is arranged in a top position, and each subtank 20 and each recording head 73 are arranged below the main tank 10 with difference of height H'. According to this constitution, ink in the main tank 10 is naturally supplied to the subtank 20 once due to head difference and fills the subtank 20. Thereafter, the ink in the subtank 20 is supplied to the recording head 73. However, as in the system in FIG. 22, an air pump 79 may be connected to the main tank 10 to compress ink in the main tank 10 to replenish the subtank 20. In this case, limitations in position of the main tank 10 are eliminated.

In FIGS. 21 to 23, for convenience, the main tank 10, the subtanks 20, the recording heads 73, and the pipe lines 75, 76, are not shown every each color ink. As a matter of fact, the main tank 10, the subtanks 20, the recording heads 73 are partitioned according to each color and connected to one another by the pipe lines 75, 76 for each color. Further, although the ink jet printer 71 includes one recording head 73 that ejects each of the above colors, one ink jet printer 71 may be provided with plural recording heads 73.

As a method of monitoring the amount of ink in each subtank 20 performed by the system controller 72, for example, a soft counting is used. This soft counting is a method of, when the ink in the subtank 20 is consumed by printing of the ink jet printer 71 or cleaning of the recording head 73, accumulatively recording the consumed ink amount of each subtank 20 in a non-volatile memory device provided in the printer body. According to this method, it is possible to monitor a state of the consumed ink amount in the subtank 20 during the printing operation by the recording head 73, so that ink management of each recording head 73 is facilitated.

The soft counting may be reset when the subtank 20 falls into a predetermined condition, for example, when a thickness of the subtank becomes a predetermined level detected by a mechanical switch (an ink high state), or when pressure in the subtank does not come to positive pressure. After then, it is counted the ink amount consumed by printing, cleaning, flushing or the like.

Hereby, since the consumed ink amount in the subtank 20 becomes nearly equal to the counted ink amount, when ink is supplied to the subtank 20 and the subtank 20 becomes the ink high state, the supplied ink amount is nearly the same as the counted ink amount. Totalizing the consumed ink amount of each subtank 20, the consumed ink amount of the main tank 10 can be exactly obtained.

Methods of supplying ink to the subtank 20 on the basis of this soft counting will be described below.

As a first example, each time ink is supplied to each subtank 20, the consumed ink amount of each subtank 20 is totalized, or it is totalized and reset. Hereby, accuracy between the total of the counted ink amount in the subtank 20 and the consumed ink amount in the main tank 10 can be improved. Further, since the ink is supplied every each subtank 20, the subtanks other than the subtank subjected to the ink supply can be used in printing, so that interruption of printing by the recording head 73 can be reduced.

As a second example, ink is supplied selectively to only a subtank requiring the ink supply, and the consumed ink amount of subtank 20 is totalized, or it is totalized and reset.

As a third example, when the consumed ink amount of each subtank 20 is totalized, ink is supplied simultaneously to all the subtanks.

In the second and third examples, loss of the supply time of ink from the main tank 10 to the subtank 20 can be reduced.

The flowing amount of ink supplied from the main tank 10 to the subtank 20 is so determined as to be the largest flowing amount of ink ejection of the recording head 73 or more. Hereby, even during the recording operation, since the amount of ink supplied from the main tank 10 to the subtank 20 is larger than the amount of ink ejection, it is possible to avoid impossibility of printing in the recording head 73. However, in a case where the valve 77 is opened during the recording operation, pressure fluctuation in the ink flowing passage is produced and the printing state changes. Therefore, it is necessary to pay an attention to the ink supply during the recording operation.

Methods of triggering the ink supply to each subtank 20 performed by the system controller 72 will be described below.

As a first example, when the apparatus is activated, the printing is performed or finished, the print paper is discharged, if the consumed ink amount in the subtank 20 is over the predetermined threshold value, ink is supplied from the main tank 10 to the subtank 20. This threshold value is set to a large value during printing by the recording head 73, and set to a small value except for that time. Hereby, the ink supply can be controlled so that ink is not supplied from the main tank 10 when the consumed ink amount in the subtank 20 is small. Therefore, time loss due to the interruption of printing in the recording head 73, which is caused by the ink supply, can be reduced.

As a second example, a residual ink amount detector that detects the amount of the residual ink in each subtank 20 is provided. Here, the system controller 72 supplies ink from the main tank 10 to the subtank 20 when the detected value indicates that the residual ink amount lowers a predetermined level, for example, when the ink high state is canceled, or the ink low state in which the negative pressure state where at least printing can be performed is effected. Hereby, since the detecting accuracy of the residual ink amount in the subtank 20 can be improved, the ink supply from the main tank 10 to the subtank 20 can be efficiently performed.

Here, for example, the ink amount detector 23 shown in FIG. 4 is attached to the subtank 20 and fixed to the fixing plate 24. By this constitution, since the ink amount detector 23 moves in accordance with the expansion or contraction of the subtank 20 due to the variation of the ink amount therein, the movement of the ink amount detector 23 may be detected by a mechanical, electrical, or optical detector, or a linear scale is attached to the ink amount detector 23 to monitor the residual ink amount and the consumed ink amount in the subtank 20. Hereby, unevenness of the consumed ink amount detected by soft counting can be suppressed.

For example, two or more residual ink amount detectors may be provided. Here, the ink supply is started after the detection of one detectors is effected, and the ink supply is terminated after the detection of the other is effected. Hereby, the exact residual ink amount can be recognized.

Alternatively, the residual ink amount detector may be single. Hereby, a cost of the residual ink amount detector can be reduced. In this case, the ink supply is performed during the detection of the residual ink amount detector is effected. Hereby, the ink supplying time can be reduced. Alternatively, the ink is supplied for a predetermined time after the detection of the residual ink amount detector is effected. Hereby, the supplying amount can be increased. Alternatively, the ink is supplied after the consumed ink amount of the subtank 10 exceeds the threshold value till the detection of the residual ink amount detector is effected. Hereby, the ink-supplying amount can be recognized most exactly, and the cost can be reduced.

The ink supply from the main tank 10 to the subtank 20 is performed each time the apparatus is activated. Hereby, the time loss due to the interruption of printing in the recording head 73, which is caused by the ink supply, can be reduced. Further, the ink supply from the main tank 10 to the subtank 20 is performed each time a predetermined time period elapses. Hereby, even in a case where the apparatus is regularly activated so that the ink supply at the time of activation cannot be performed, the ink supply from the main tank 10 to the subtank 20 can be surely performed. Alternatively, the ink supply may be performed each time the apparatus is activated and each time the predetermined time period elapses.

Ink of the amount consumed per a day may be supplied from the main tank 10 to the subtank 20 at once. Hereby, the ink supplying operation is performed only when the apparatus is activated. Therefore, the interruption of the recording operation due to the ink supplying operation can be eliminated, and efficiency of the recording processing can be improved. Here, the order of the ink supply from the main tank 10 to the subtank 20 is not particularly limited. For example, regardless of height of the layout of the subtank 20, length of the supplying passage, or the consuming amount, the ink may be supplied from an arbitrary subtank 20.

Methods of terminating the ink supply performed by the system controller 72 will be described below.

As a first example, each time printing is performed by the recording head 73, the consumed ink amount of each subtank 20 is totalized thereby to calculate the residual ink amount in the main tank 10, and ink is supplied from the main tank 10 to the subtank 20. When the system controller 72 judges an ink end state of the main tank 10, all the recording heads 73 is brought into an ink end state. Hereby, the total of the consumed ink amount in the subtanks 20 becomes equal to the consumed ink amount of the main tank 10, so that the ink supply from the main tank 10 to the subtank 20 can be surely performed.

In this case, after the ink end state of the main tank 10 is detected, recording is performed by the recording head 73 till the consumed ink amount of each subtank 20 becomes a predetermined value or more. Hereby, the amount of the residual ink in the main tank 10 is exactly counted, and the ink in the subtank 20 is not used uselessly.

As a second example, when the ink is supplied from the main tank 10 to the subtank 20, the system controller 72 compares the consumed ink amount in each subtank 20 and the residual ink amount in the main tank 10. When the consumed ink amount is smaller than the ink residual ink, the ink is supplied; and when the consumed ink amount is larger than the ink residual ink, the system controller 72 judges the main tank 10 is in the ink end state so that. Hereby, the ink supply from the main tank 10 to the subtank 20 can be surely performed. When the consumed ink amount is larger than the ink residual ink, the system controller 72 may compare the consumed ink amount of all the subtanks 20 with the residual ink amount of the main tank 10 without performing ink supply. If the former is larger than the latter, the system controller 72 judges the main tank 10 is the ink end state. Hereby, the useless ink amount can be reduced.

Alternatively, even when the consumed ink amount is larger than the ink residual ink, the ink supply ink may be performed only once before the ink end state is judged. Hereby, even in a case where there is unevenness in the residual ink amount in the main tank 10, the ink in the main tank 10 can be consumed as much as possible. Alternatively, even when the consumed ink amount is larger than the ink residual ink, the ink is supplied; and in a case where the residual ink detector does not change, the system controller 72 judges the main tank 10 is in the ink end state. Hereby, an influence by unevenness of the consumed ink amount can be eliminated.

As a method of supplying ink to the subtank 20 not using the soft counting method, when the system controller 72 judges the residual ink amount to be the ink high state, that is, to be nearly full from the detection value by the ink amount detector 23, the valve 77 is closed thereby to stop the ink supply from the main tank 10 to the subtank 20. Hereby, even if the apparatus is deactivated on the way, the residual ink amount in the subtank 20 can be surely detected. Therefore, a disadvantage is not produced in the ink supply from the main tank 10 to the subtank 20.

This method is performed every each subtank 20, in only the predetermined subtank 20, or simultaneously in all the subtanks 20. Hereby, the ink supply from the main tank 10 to the subtank 20 can be readily performed. Here, in a case where this method is performed in all the subtanks 20 simultaneously, there is the following disadvantage. When the valves 77 of the all the subtanks 20 are open, the ink moves from the upper subtank 20 to the lower subtank 20, for example, by the head difference. If the apparatus is deactivated in a state where the ink in the upper subtank 20 is empty, the corresponding recording head 73 cannot perform printing.

To avoid such a situation, the valve 77 is closed when the system controller 72 judges the subtank 20 becomes the ink low state based on the detection value by the ink amount detector 23.

An ink end detector may be provided with the main tank 10. In this case, the system controller 72 judges the ink end state upon reception of a detection signal from the ink end detector. After the main tank 10 is replaced with a new one, ink is supplied to the subtank 20 till the ink amount detector 23 detects that the subtank 20 is in the ink full state. Hereby, the system constitution can be simplified.

According to the above configurations, since only ink in the single main tank 10 is managed, the ink supply to the plural recording heads 73 is stabilized, and printing quality can be improved.

Besides, a memory device for storing the residual ink amount in the main tank 10 may be attached to the main tank 10, whereby ink management can be performed more specifically.

In each of the above embodiments, although the subtank 20 is provided with the adhesion guard 22, it may be omitted from the subtank 20.

Although the printer is explained as an example, a facsimile machine and a copying machine may be adopted as an ink jet recording apparatus if a main tank and a subtank are provided therein.

The invention claimed is:

1. An ink supply system, comprising:

a main tank, which stores ink therein;

a plurality of subtanks, communicated with the main tank;

at least one recording section, communicated with at least one of the subtanks; and a system controller, which is coupled to each of the subtanks and the main tank and monitors an ink amount consumed in each subtank to manage a residual ink amount in the main tank; and wherein the system controller starts to count the consumed ink amount of the subtank when an ink amount stored in the subtank reaches a predetermined level.

2. The ink supply system as set forth in claim 1, wherein each subtank is airtightly formed by a material having flexibility so that a volume of the subtank is variable.

3. The ink supply system as set forth in claim 2, wherein each subtank contains a plate member which prevents inner surfaces of the subtank from being adhered with each other.

4. The ink jet recording apparatus as set forth in claim 3, wherein grooves are formed on surfaces of the plate member.

5. The ink supply system as set forth in claim 1, wherein the system controller equates a total ink amount consumed in all the subtanks as an ink amount consumed in the main tank.

6. The ink supply system as set forth in claim 1, wherein the system controller obtains the consumed ink amount of each subtank every time when the subtank is replenished with ink supplied from the main tank.

7. The ink supply system as set forth in claim 1, wherein the system controller selectively controls the supply of ink to at least one subtank, and obtains the consumed ink amount of the at least one subtank.

8. The ink supply system as set forth in claim 1, wherein the system controller obtains the consumed ink amount of each subtank, and controls the supply of ink to all the subtanks simultaneously.

9. The ink supply system as set forth in claim 1, wherein a flow rate of ink flowing into the subtank is greater than a flow rate of ink flowing out from the recording section associated with the subtank.

10. The ink supply system as set forth in claim 1, wherein the system controller starts to supply ink to the subtank when the ink amount consumed in the subtank exceeds a threshold level.

11. The ink supply system as set forth in claim 10, wherein the threshold level includes a first threshold level selected while the recording section performs recording, and a second threshold level which is smaller than the first threshold level selected while the recording is not performed.

12. The ink supply system as set forth in claim 10, wherein:

each of the subtanks is provided with at least one detector which detects a residual ink amount therein; and the system controller stops the ink supply to each of the subtanks when a detection by the detector is effected.

13. The ink supply system as set forth in claim 1, wherein:

each subtank is provided with at least one detector which detects a residual ink amount therein; and the system controller controls the supply of ink to the subtank when the detector detects that the residual ink amount is a predetermined level or less.

14. The ink supply system as set forth in claim 13, wherein:

a first detector and a second detector are provided with each subtank; and the system controller controls the supply of ink to an associated one of the subtanks when a detection by the first detector is effected, and stops the ink supply of ink to associated one of the subtanks when a detection by the second detector is effected.

15. The ink supply system as set forth in claim 13, wherein the detector is solely provided.

16. The ink supply system as set forth in claim 15, wherein the system controller controls the supply of ink to an associated one of the subtanks during a detection by the detector.

17. The ink supply system as set forth in claim 15, wherein the system controller controls the supply of ink to an associated one of the subtanks for a predetermined time period when a detection by the detector is effected.

18. The ink supply system as set forth in claim 13, wherein:

a valve member is provided between the main tank and each of the subtank; and the valve member is closed when the detector detects that the residual ink amount is a predetermined level or more.

19. The ink supply system as set forth in claim 18, wherein each valve member is closed independently from another valve members.

20. The ink supply system as set forth in claim 18, wherein each valve member is closed selectively by said system controller.

21. The ink supply system as set forth in claim 18, wherein all the valve members are closed simultaneously.

22. The ink supply system as set forth in claim 21, wherein all the valve members are closed when at least one detector among the detectors of the subtanks detects that one subtank is almost empty.

23. The ink supply system as set forth in claim 1, wherein the system controller controls the supply of ink from the main tank to each of the subtanks every time when the system is activated.

24. The ink supply system as set forth in claim 1, wherein the system controller controls the supply of ink from the main tank to each subtanks every time when a predetermined time period elapses.

25. The ink supply system as set forth in claim 1, wherein the system controller controls the supply of ink from the main tank to the subtank after obtaining the consumed ink amount of each subtank to calculate a residual ink amount in the main tank, every time when the recording section performs recording.

26. The ink supply system as set forth in claim 1, wherein:

the system controller obtains the consumed ink amount of each subtank every time when the recording section performs recording to calculate a residual ink amount in the main tank; and an ink supply end state is effected in all the recording section communicated with each of the subtanks when the residual ink amount in the main tank is a predetermined level or less.

27. The ink supply system as set forth in claim 26, wherein the recording section continues the recording until a predetermined amount of ink in the subtank is consumed after the ink end state is effected.

28. The ink supply system as set forth in claim 1, wherein:

the system controller sequentially compares the ink amount consumed in each subtank and a residual ink amount in the main tank;

the system controller supplies ink to the compared subtank when the consumed ink amount of the compared subtank is less than the residual ink amount; and an ink supply end state is effected when the consumed ink amount of the compared subtank is greater than the residual ink amount.

29. The ink supply system as set forth in claim 28, wherein the ink supply is once performed even when the ink supply end state is effected.

30. The ink supply system as set forth in claim 28, wherein the ink supply is performed until any change is not occurred in the detector, even when the ink supply end state is effected.

31. The ink supply system as set forth in claim 1, wherein:

the system controller sequentially compares the ink amount consumed in each subtank and a residual ink amount in the main tank;

the system controller supplies ink to the compared subtank when the consumed ink amount of the compared subtank is less than the residual ink amount;

the system controller does not supply ink to the compared subtank when the consumed ink amount of the compared subtank is greater than the residual ink amount; and an ink supply end state is effected when there is at least one subtank to which ink is not supplied.

32. The ink supply system as set forth in claim 1, wherein:

the main tank is provided with a first detector which detects a residual ink amount in the main tank; and an ink supply end state is effected when the first detector detects that the residual ink amount is a predetermined amount or less.

33. The ink supply system as set forth in claim 32, wherein:

each subtank is provided with a second detector which detects a residual ink amount therein; and the system controller stops the ink supply when the second detector detects that the subtank is almost full when the ink supply end state is effected.

34. The ink supply system as set forth in claim 1, further comprising a memory coupled to said system controller for storing a determined residual ink amount in the main tank.

35. A method of managing an ink amount supplied from main tank to the subtanks which are provided in the ink system as set forth in claim 1.

36. The ink supply system as set forth in claim 1, wherein said system contains a plurality of the recording sections, and further comprises a plurality of printer units, each of which comprises one of the subtanks and one of the recording sections.

37. The ink supply system as set forth in claim 36, wherein the subtank in one of the printer units and the subtank in another one of the printer units are communicated with the main tank in a parallel manner.

* * * * *